United States Patent [19]

Van Tassel

[11] Patent Number: 4,941,423

[45] Date of Patent: Jul. 17, 1990

[54] MARINE PROPULSION SYSTEM

[75] Inventor: Gary W. Van Tassel, Lusby, Md.

[73] Assignee: Ocean Tech Marine, Inc., North Bergen, N.J.

[21] Appl. No.: 108,582

[22] Filed: Oct. 13, 1987

Related U.S. Application Data

[63] Continuation-in-part of Ser. No. 874,568, Jun. 16, 1986, abandoned.

[51] Int. Cl.[5] ..... B63H 5/16

[52] U.S. Cl. ..... 114/289; 114/290; 440/69; 440/70

[58] Field of Search ..... 114/288, 289, 290, 271, 114/61, 62, 185,-57 R, 67 A, 211, 212; 440/47, 68, 89, 66, 70, 111, 112

[56] References Cited

U.S. PATENT DOCUMENTS

| | | | |
|---|---|---|---|
| 3,091,206 | 5/1963 | Cale | 114/289 |
| 3,203,389 | 8/1965 | Cale | 114/289 |
| 3,604,385 | 9/1971 | Reider | 114/289 |
| 4,165,703 | 8/1979 | Burg | 114/289 |
| 4,353,318 | 10/1982 | Williams | 114/211 |

FOREIGN PATENT DOCUMENTS

| | | | |
|---|---|---|---|
| 2906983 | 9/1980 | Fed. Rep. of Germany | 114/289 |

*Primary Examiner*—Joseph F. Peters, Jr.
*Assistant Examiner*—Clifford T. Bartz
*Attorney, Agent, or Firm*—George W. MacDonald, Jr.

[57] ABSTRACT

A propulsion system for high-speed powerboats whereby the water level in a tunnel containing a surface-piercing propeller is controlled by admitting external air into the tunnel through an air outlet in the tunnel forward of the propeller. The air is admitted through a duct which has an air intake on the exterior of the boat. The duct may contain a valve which may be opened or closed to control the air supply. Particular configurations of the tunnel and the air supply system are disclosed which maximize the ability to control the water level in the tunnel and the degree to which the propeller is submerged as well as best utilize the configuration of the vessel.

80 Claims, 21 Drawing Sheets

MARINE PROPULSION SYSTEM

This application is a continuation-in-part of application Ser. No. 874,568, filed June 16, 1986, now abandoned, for a MARINE PROPULSION SYSTEM.

BACKGROUND OF THE INVENTION

The present invention relates to an improved propulsion system for powerboats. It is well known that the use of a so-called surface-piercing propeller, wherein the propeller runs partially out of the water, will propel a high speed, light weight power boat with greater efficiency, and therefore at speeds higher than those attainable by a propeller which runs fully submerged. However, surface-piercing propellers are known to be inefficient in slow speed operation and they have difficulty in moving a boat onto a plane for high speed operation. Various systems are known which provide for both slow speed, fully submerged, operation and high speed, half-submerged operation of the same propeller. One such system known to the art places a surface-piercing propeller in a tunnel located at the aft underbody of the boat. In such a system, the propeller may run either fully submerged at slow speed, with a considerable increase in thrust, or half submerged, at high speed. Such a system is described in U.S. Pat. No. 3,793,980, issued Feb. 26, 1976.

It is known that in tunnel operation, efficient operation of the propeller is to some degree dependent upon ventilation of the tunnel. Ventilation is known to help to eliminate cavitation and the inefficient operation of the propeller resulting therefrom. Traditionally, however, tunnel ventilation has been achieved by air being admitted to the tunnel from the transom (stern) end of the tunnel. Such a system is described in U.S. Pat. No. 4,371,350, issued Feb. 1, 1983.

It has been found that ventilating air admitted from the stern end of the tunnel is insufficient to fully ventilate the tunnel so that maximum operating efficiency by the propeller may be obtained. This appears to be at least in part the result of the heavy spray, generated by a surface-piercing propeller operating at high speeds, exiting the stern end of the tunnel.

SUMMARY OF THE INVENTION

It is therefore a principal object of the present invention to provide a more efficient powerboat propulsion system of the type utilizing a surface-piercing propeller located in a tunnel in the aft underbody of the boat.

According to the present invention, once the powerboat equipped with the present invention has achieved planing speed, ventilating air is admitted to the tunnel containing the propeller from an opening or openings located in the tunnel forward of the propeller. As a result, the water surface at the forward end of the tunnel is broken free and the water is not drawn up into the tunnel. Instead, a free water surface, necessary for the efficient operation at planing speeds of the surface-piercing propeller, is created in the tunnel. Because ventilating air from the transom end of the tunnel is not required, the ventilation problems created by the propeller-created surface spray are avoided and complete and efficient ventilation of the tunnel is achieved.

The present invention leads to substantial improvement in operating efficiency and performance. Higher speeds for the same engine power output are achieved or, conversely, the same speed requires less engine power than in conventional, fully submerged propeller systems.

It also has been found that in powerboats equipped with the present invention the transition to planing speeds through the high resistance transition point, "Hump Speed", that precedes planing speed is smooth and easily achieved at engine power levels comparable to those required in a conventional system. Once onto a plane, and air is admitted to the end of the tunnel forward of the propeller, the transition to surface-piercing mode is smooth and controlled. Propeller-induced hull vibration, always a problem with inboard engine-powered, high speed boats, is significantly reduced once in the surface-piercing mode. The transition to fully flooded, submerged propeller operation is equally smooth, requiring only that air no longer be delivered to the opening(s) in the tunnel forward of the propeller.

Other advantages of the present invention are that the detrimental effects of cavitation in high speed operation are eliminated or significantly reduced and that propeller-generated noise is significantly reduced in comparison to conventional, submerged propeller, inboard propulsion systems.

In one manifestation of this invention, air at atmospheric pressure is admitted to the tunnel forward of the propeller through an air intake duct which has a valve at its external forward opening. When the valve is opened, air is drawn into the tunnel. In one embodiment, the valves are controllable and may be opened to different degrees. As a result, variable amounts of air may be admitted to the tunnel.

In one embodiment of the present invention, the valve controlling the flow of air to the air inlet duct is controlled from the control console of the boat. Activation of the valve control opens the air valve and initiates tunnel ventilation.

In another, preferred, embodiment, once planing speed has been attained, air is admitted to the tunnel forward of the propeller through an inlet located in the transom of the boat, in the area adjacent to the external opening of the tunnel. The external air passes through the inlet into a duct, where it is conveyed to the tunnel forward of the propeller. In this embodiment, no air control valves are employed, and the air enters the inlet and duct when the boat achieves planing speed and a partial vacuum is created in the tunnel. Several external openings and ducts or openings and ducts of different configurations are contemplated. Above planing speed, the volume of air admitted is proportional to the speed of the boat. Below planing speed, air is not drawn into the tunnel via the inlet and duct.

As another aspect of the present invention, a tunnel of a particular configuration is contemplated. As will be more specifically shown below, in this configuration, the propeller, attached to a propeller shaft, is located at approximately the longitudinal midlength of the tunnel. For a short distance forward and aft of the propeller, the tunnel is of a semi-circular configuration with a radius slightly greater than that of the propeller, in order to accommodate the propeller in operation. A strut of a conventional design is located slightly forward of the propeller in order to provide support for the propeller shaft and propeller. The forward part of the tunnel is rectangular in cross-section and contains the air inlet. In this embodiment, the bottom surface of the tunnel in the forward area contains a plate which forms an extension of the hull bottom. Aft of the semi-circular portion of the tunnel, in the area of the transom, the top of the tunnel assumes a flat configuration, the rudder being fitted in the rearmost part of this flat area. The flat area of the tunnel performs the following functions: It provides a flat area for rudder(s) to be fitted, allowing proper rudder swing; it acts as a trim tab, when the tunnel is fully flooded, to assist the boat to overcome the high resistance point, "Hump Speed", just below planing speed; it depresses the spray caused by the surface-piercing propeller; and it acts to further limit the air drawn into the tunnel from the aft end of the tunnel when in reverse operation.

The present invention may be used with any vessel capable of attaining planing speed with a hull form that can accommodate a tunnel. The present invention also contemplates the use of one or more tunnels, limited solely by geometric constraints imposed by hull form, propeller size, engine power, vessel speed, and the like. In a preferred embodiment, the boat has two tunnels, each with a propeller and an air duct or ducts located forward of the propeller. Similarly, the number of air ducts, their size, and their arrangement may be varied, again depending upon the geometry and physical constraints of the boat, and the need to deliver the required amount of air to the tunnel. It has been found that the location of the outlet openings of the air ducts in the tunnel is not critical, as long as they are located forward of the propeller. However, it has been found that for more efficient operation the distance of the air inlets to the air outlet openings in the tunnel should be as short as possible. The only limitation on the location of the external air inlets is that they should be located in clear air, free of heavy spray.

DETAILED DESCRIPTION OF THE PREFERRED EMBODIMENTS

Figure 1:
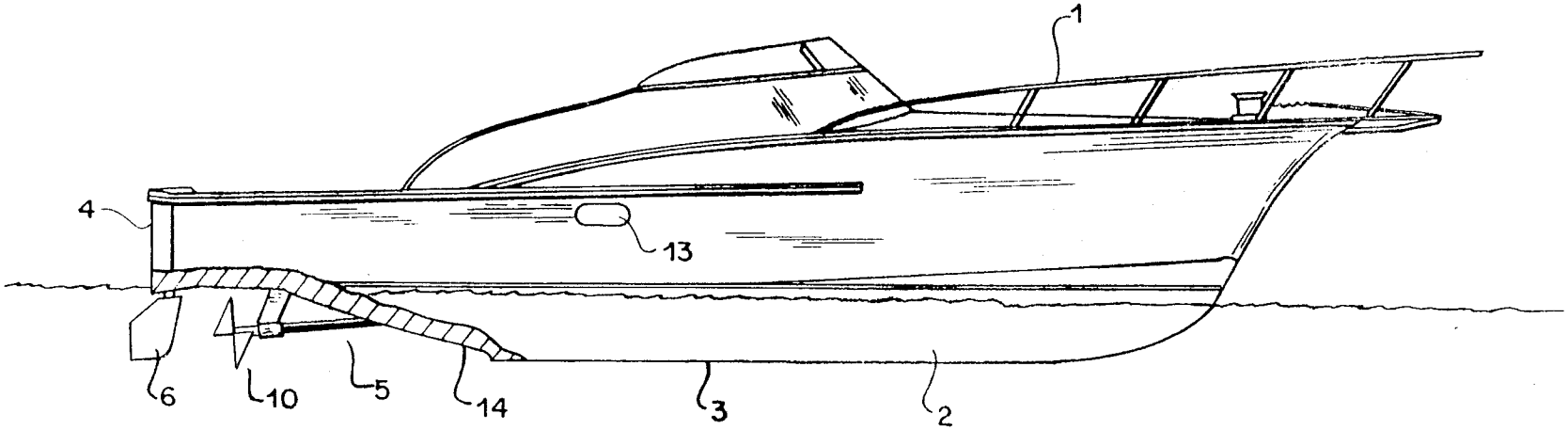
FIG. 1 is a side view of a marine vessel illustrating one embodiment of the present invention.

Referring to the drawings, in FIG. 1 there has been illustrated a marine vessel 1, having a hull 2 with a bottom 3. On the rear underside of the hull of the vessel is formed a tunnel 5 containing a surface-piercing propeller 10.

A rudder 6 is located at the stern or transom of the vessel. An air inlet port 13 is located on the side of the hull 2 of the vessel.

Figure 2:
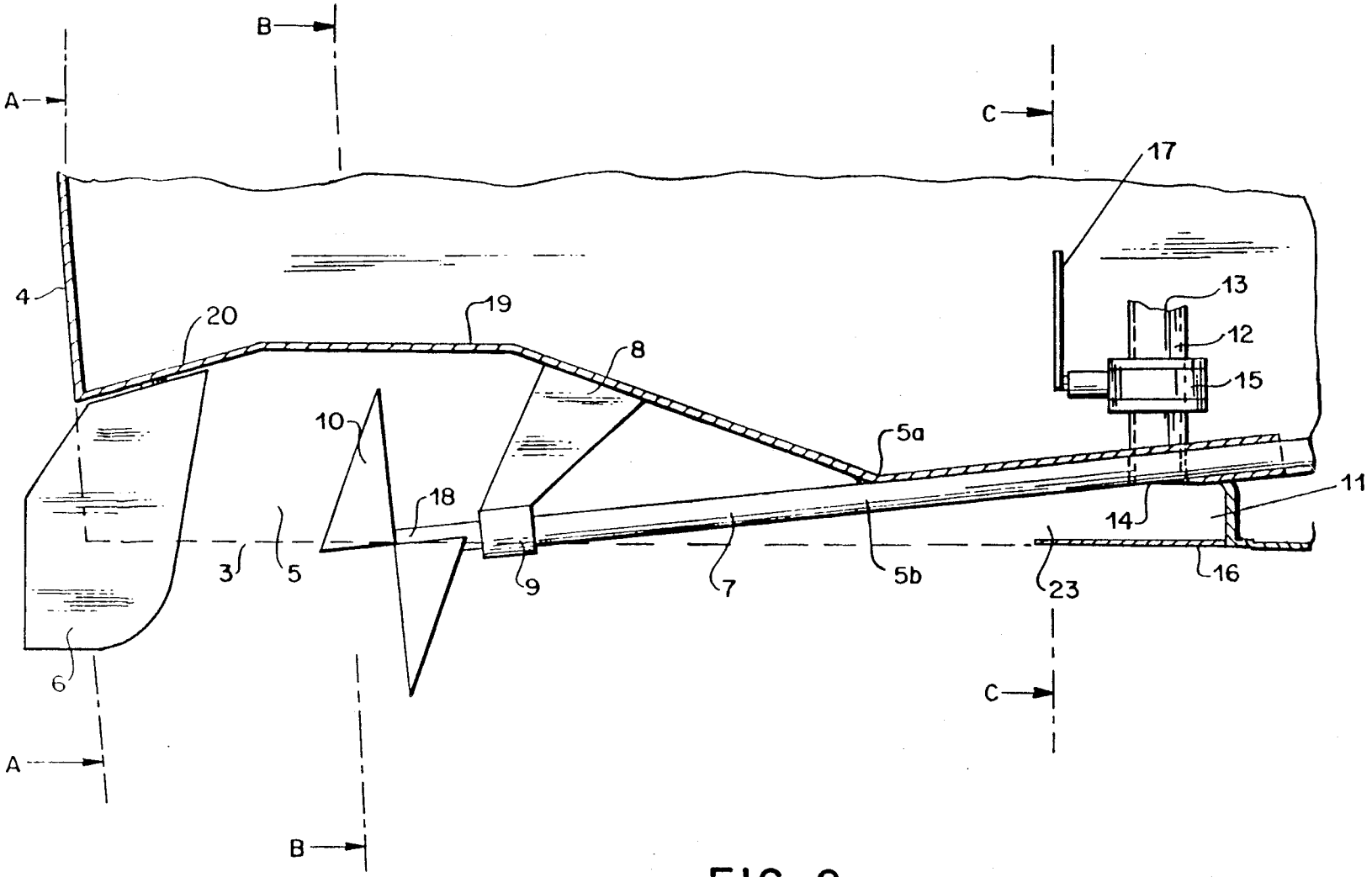
FIG. 2 is a fragmentary longitudinal sectional view showing part of the stern of the marine vessel shown in FIG. 1, including one embodiment of a tunnel and air delivery arrangement according to the present invention.

Referring to FIG. 2, which shows the aft underside of a vessel equipped with one embodiment of the present invention, there is a tunnel 5, within which are located a surface-piercing propeller 10, and a propeller shaft 7, which is supported by a propeller strut 8. The propeller strut 8 is attached to a shaft bearing 9.

Figure 4:
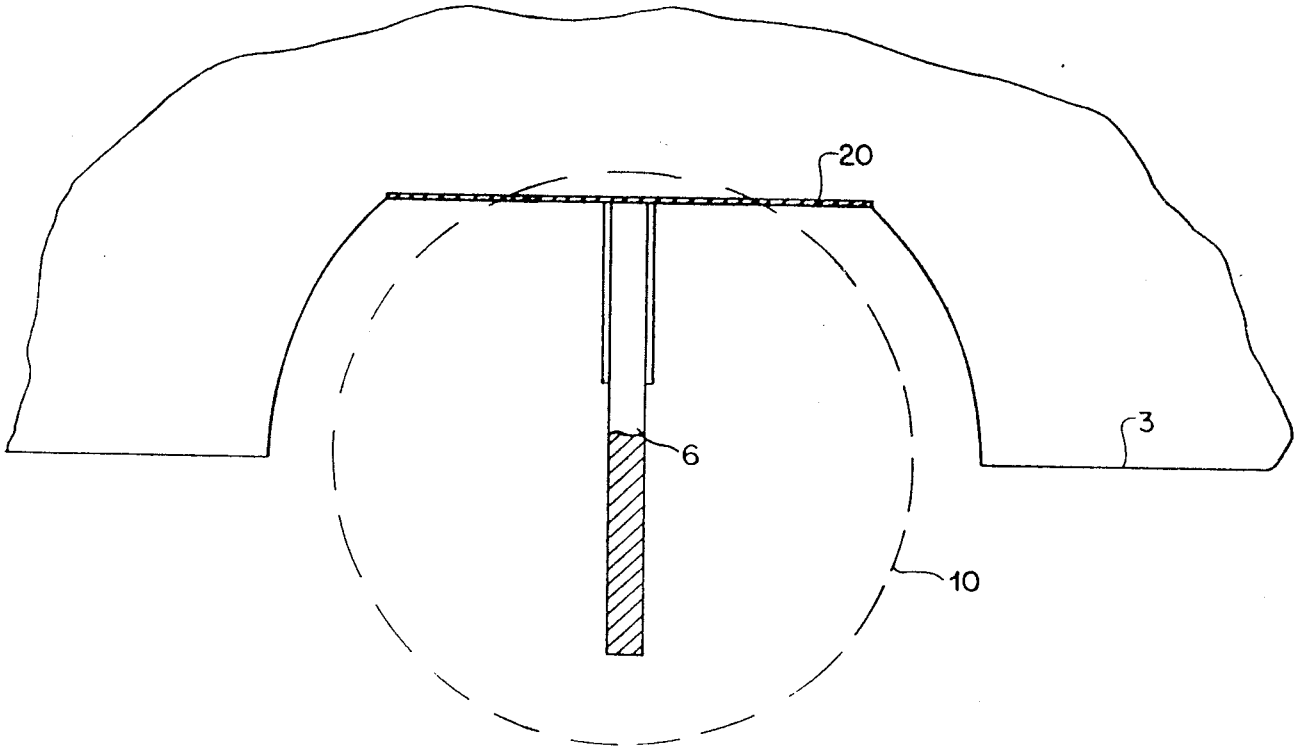
FIG. 4 is a fragmentary lateral sectional view taken along the line A—A of FIG. 2.
Figure 5:
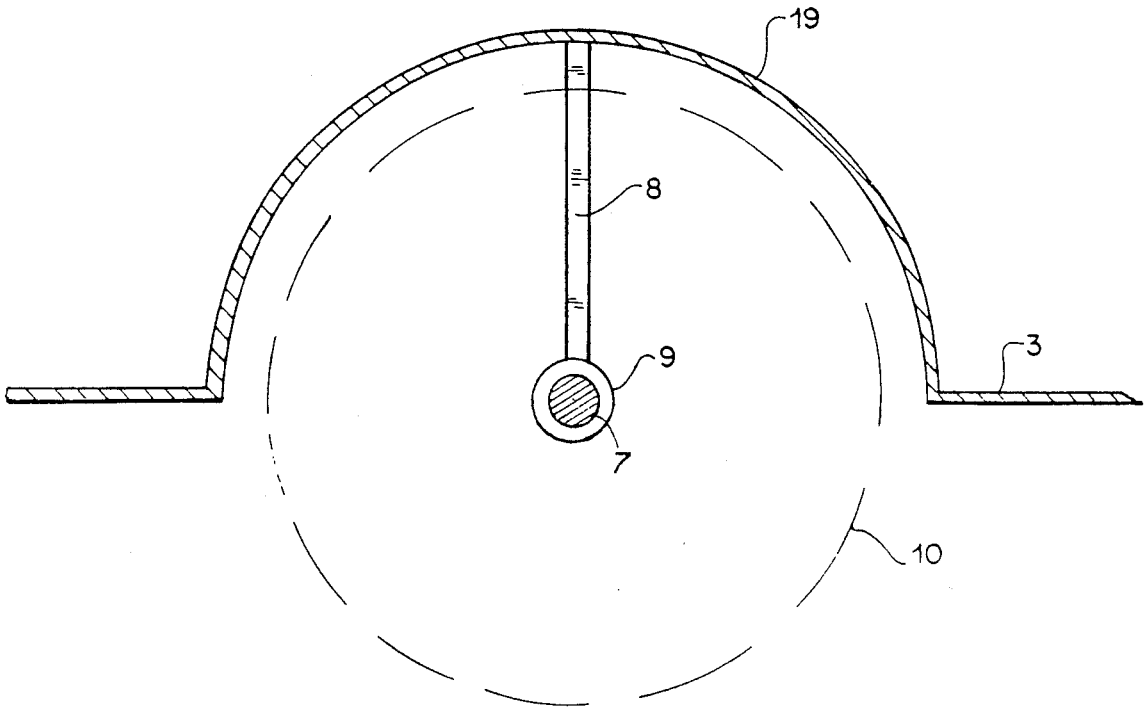
FIG. 5 is a fragmentary lateral sectional view taken along the line B—B of FIG. 2.

The placement of the propeller 10 within the tunnel 5 is illustrated in a number of FIGS., in particular, FIGS. 2, 4, and 5. For convenience, the same structure or reference point is referred to by the same number in the different FIGS. It will be seen therefrom that the diameter of the tunnel 5 in the vicinity of the propeller 10 is sufficient to provide operating clearance for the propeller.

In the configuration of the tunnel illustrated in FIG. 2, it will be seen that forward of the propeller 10, the tunnel 5 diminishes in height. Forward of the point 5*a* at which the propeller shaft 7 enters the tunnel, the height of the tunnel remains relatively constant and, as may better be seen in FIG. 6, the top 5*b* of the tunnel is flat. Referring to FIG. 2, it will be seen that at the forward end 11 of the tunnel 5 is located an air inlet duct 12. The air inlet duct 12 is open to and receives air via an air intake or inlet opening 13, which, in one embodiment, is illustrated in FIG. 1. The air passing through the air inlet duct 12 enters the tunnel 5 forward of the propeller 10 at an air outlet opening 14.

It will further be seen from FIG. 2 that located on air inlet duct 12 is an air inlet valve 15, which may be fully or partially opened or shut to admit variable volumes of air.

In one embodiment, the air valve 15 is remotely controllable from the vessel's control console by a control for some or all of the air ducts of the present invention in the vessel. Activation of the control opens the air valves and initiates tunnel ventilation.

Figure 6:
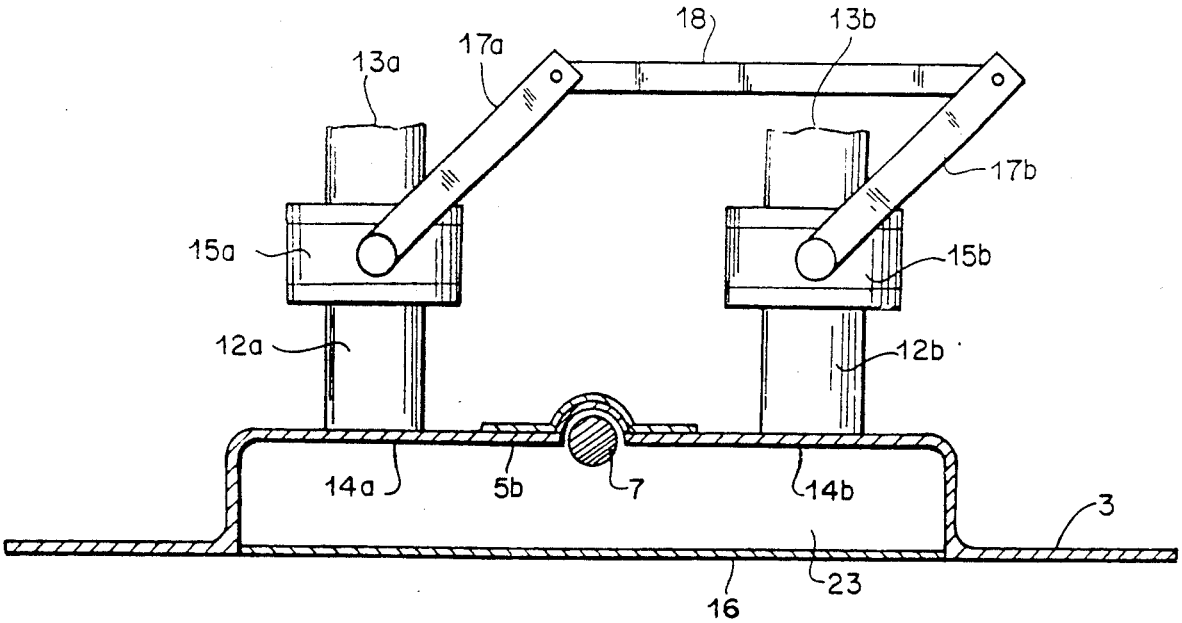
FIG. 6 is a fragmentary lateral sectional view taken along the line line C—C of FIG. 2, showing the air intake valves and air inlet duct.

In FIG. 6 is illustrated an embodiment of the air delivery system illustrated in FIG. 2. In FIG. 6 two air inlet ducts 12*a* and 12*b* are shown, each with its air inlet opening 13*a* and 13*b*. Each of the air inlet ducts 12*a* and 12*b* has an air intake valve 15*a* and 15*b*, whereby the flow of air through the air inlet ducts may be variably controlled. The air intake valves 15*a* and 15*b* illustrated by FIG. 6 are opened or closed by operating arms 17*a* and 17*b*, which are connected by a linkage 18, permitting simultaneous and parallel operation of the air intake valves 15*a* and 15*b*.

FIGS. 2, 4, 5 and 6 illustrate the shape of the tunnel 5. With particular reference to FIGS. 2 and 5, it will be seen that the configuration of the tunnel in the vicinity 19 of the propeller 10 is semi-circular and slightly larger in diameter than the propeller 10 to provide clearance for the propeller. At this point in the tunnel 5, the propeller 10 is positioned one-half above what would be, but for the tunnel, the bottom 3 of the vessel and one-half below. Just forward of the propeller 10 is located a strut 8, which provides support at a bearing 9 for the propeller shaft 7 and the propeller 10.

With particular reference to FIGS. 2 and 4, it will be seen that in longitudinal cross-section, aft of the vicinity 19 of the propeller 10, the top 20 of the tunnel 5 becomes flat and then descends to the vicinity of the transom 4. As may be seen from FIG. 2, and in lateral cross-section in FIGS. 4 and 5, the tunnel, which has a semi-circular configuration in the vicinity 19 of the propeller, assumes a rectangular cross-sectional configuration, with a flat roof 20, as it approaches the transom area 4 of the vessel. Similarly, as is shown in FIG. 2 and in lateral cross-section in FIG. 6 the tunnel roof 5*b* forward of the vicinity 19 of the propeller is flat and the forward tunnel area 23 is generally rectangular in cross-section. The flat areas of the tunnel roof, forward and aft of the vicinity 19 of the propeller, are smoothly blended into the semi-circular section 19 of the tunnel. The flat area 20 aft of the propeller permits the rudder 6 to be fitted and permits rudder movement 35 degrees port or starboard for steering. The flat area 20 of the tunnel 5 also acts as a trim tab when the tunnel is fully flooded to assist the vessel in overcoming the pre-planing speed resistance barrier. When the intake valve 15 is open and the tunnel is fully ventilated, the flat area 20 of the tunnel also tends to contain and depress the considerable spray generated by a surface-piercing propeller operating at high speed.

When running astern, the flat area 20 of the tunnel also assists in lowering the top of the tunnel toward the surface of the water and thereby tends to reduce the tendency of the propeller to draw air from the stern. As a result, astern performance of a vessel configured and equipped according to the present invention has been demonstrated to be equivalent to that of similar vessels fitted with conventional fully submerged propeller systems. FIGS. 2 and 6 illustrate one embodiment of the present invention whereby the bottom forward surface of the tunnel is enclosed by a flow separation plate 16. The flow separation plate 16 assists in providing a clear air-water separation at the forward end of the tunnel and thereby a defined water surface for the propeller. The flow separation plate 16, which forms an extension of the hull bottom 3, also assists in providing unobstructed air in the tunnel, thereby permitting easier access of air via the air inlet duct 12 and the air outlet 14.

Figure 3:
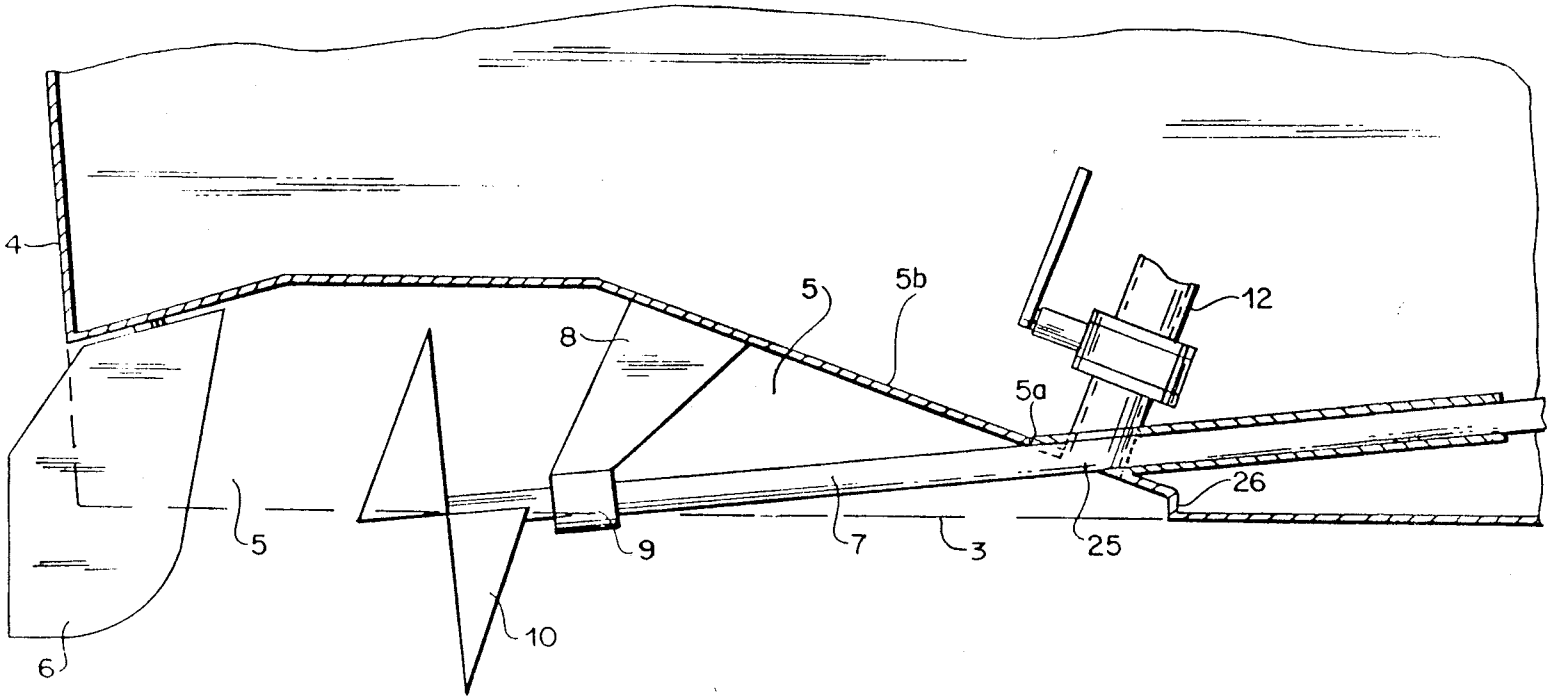
FIG. 3 is a fragmentary longitudinal sectional view showing part of the stern of the marine vessel shown in FIG. 1, illustrating another embodiment of a tunnel and air delivery arrangement.

In FIG. 3 is illustrated a longitudinal cross-section showing a preferred embodiment of my invention, with another and preferred configuration of the tunnel. Aft of the propeller 10, the configuration of the tunnel 5 is identical to the arrangement illustrated in FIG. 2. As is also the case in FIG. 2, forward of the propeller 10, the roof 5*b* of the tunnel 5 assumes a downward slope. However, in the configuration illustrated in FIG. 3 the forward tunnel roof 5*b* descends beyond the point 5*a* at which the propeller shaft 7 enters the tunnel 5. This is unlike the configuration of the tunnel illustrated in FIG. 2 wherein the descent of the tunnel roof 5*b* ceases at point 5*a*. In the FIG. 3 configuration, the descending tunnel roof 5*b* terminates in a 1" high vertical wall 26 which rises from the hull bottom 3. In this embodiment there is no flow separation plate (16, in FIG. 2) and the air outlet 25 of air inlet duct 12 is located just aft of the 1" high vertical wall 26. In lateral cross-section, the configuration of the tunnel illustrated in FIG. 3 is the same as appears in FIG. 6, that is, essentially rectangular and with a flat roof.

Figure 7:
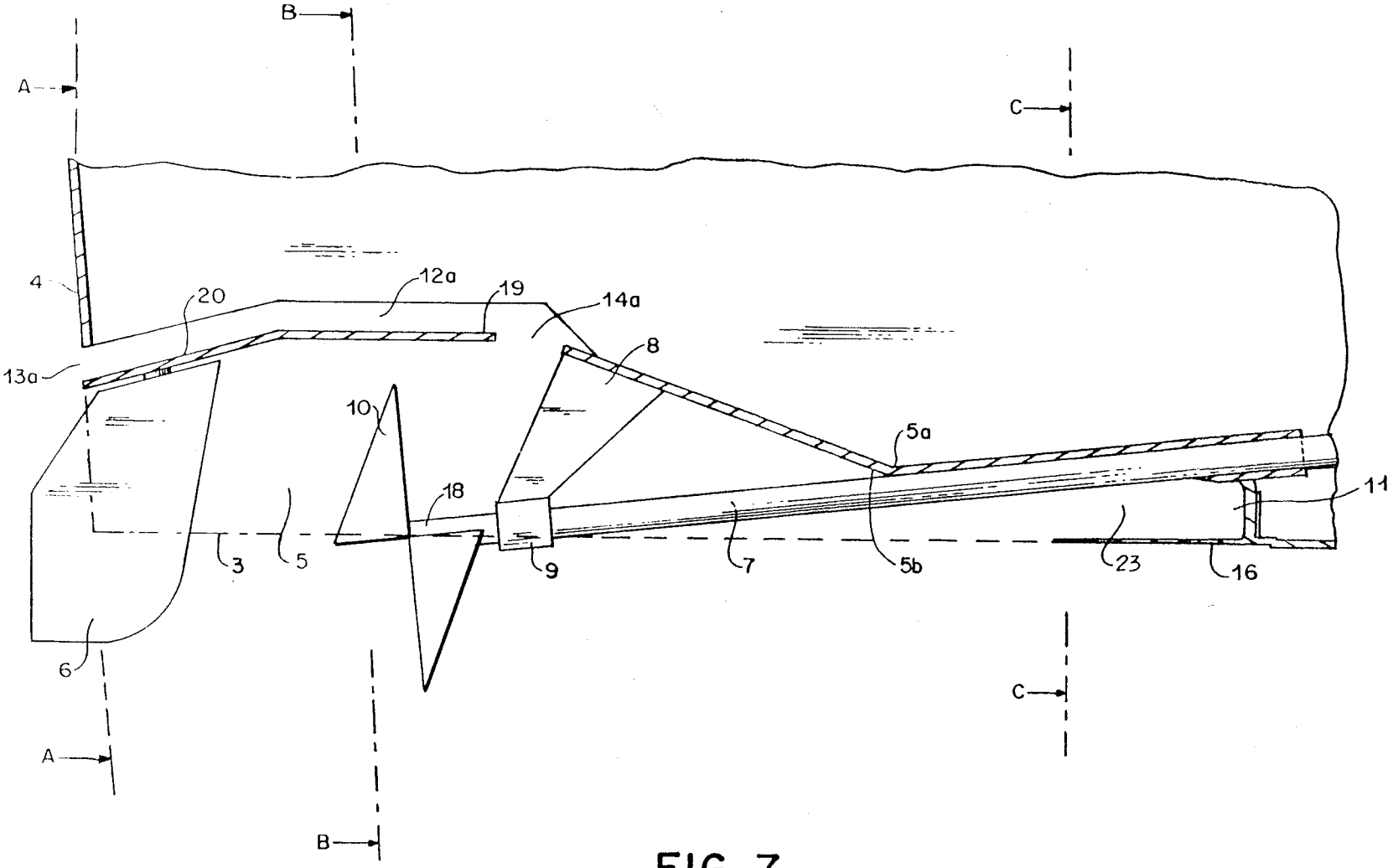
FIG. 7 is a partial sectional view, corresponding to the tunnel design of FIG. 2, illustrating a preferred embodiment of a tunnel and air delivery arrangement according to the present invention.

In FIG. 7 is illustrated a preferred embodiment of the air supply system of the present invention. It has been found in connection with the present invention that as long as the air being supplied to the tunnel is of sufficient volume, and as long as the air outlets are located forward of the propeller, the number, location, diameter, and shape of the air inlets, air transport ducts, and air outlets in the tunnel are not in themselves critical but are determined by such factors as the internal and external configuration of the vessel.

The embodiment of FIG. 7 is, however, preferred because it provides an adequate flow of air to the tunnel forward of the propeller with maximum simplicity and efficiency. It has been found that in boats of a given size and speed, the forward motion of the vessel, once planing speed is attained, is sufficient, it is believed, to create a partial vacuum in the tunnel whereby air is drawn into the tunnel via the external air inlet or inlets and the air duct or ducts. In such an embodiment, valves, controllable or otherwise, are unnecessary, and the air supply is self-regulated by the speed of the boat.

FIG. 7 is an example of such an air supply arrangement. FIG. 7 illustrates a tunnel 5, the configuration of which is essentially identical to that shown in FIG. 2.

The FIG. 7 arrangement, however, differs in that air inlet valve 15 (FIG. 2) is missing and air is admitted to the tunnel 5 at air inlet 13*a*, located in the transom 4, and passes through air supply duct 12*a*, which is located above and in juxtaposition with the roof 20 of tunnel 5, where it is admitted to the tunnel 5 forward of the propeller 10 at air outlet 14*a*.

One of the inventive advantages of the present invention is that the air admitted to the forward end of the tunnel is free of the spray generated by the propeller and which, according to prior inventions, is a large component of the air entering the tunnel from the transom end of the tunnel. Such prior methods of ventilating the tunnel have been found to be, at best, inefficient and, more likely, inoperative. According to the present invention, air admitted to the tunnel via an air outlet or outlets located forward of the propeller, among other things, acts to suppress or remove the spray admitted from the transom end of the tunnel. It has been found that air admitted at inlet opening 13*a* (in FIG. 7), although located above the transom end of the tunnel 5, is in fact free of spray. This appears to be because the forward motion of the boat, above planing speeds, creates a partial vacuum in the tunnel, sucks air into the tunnel through the inlet opening 13*a* and through the air duct 12*a*, and forces the same air out through the transom end of the tunnel 5 at such a velocity as to provide a relatively spray-free environment in the area just aft of the transom of the boat, the area in which the air inlet opening 13*a* of FIG. 7 is located. The air thus admitted to the tunnel 5 in this embodiment is therefore free of spray.

Figure 8:
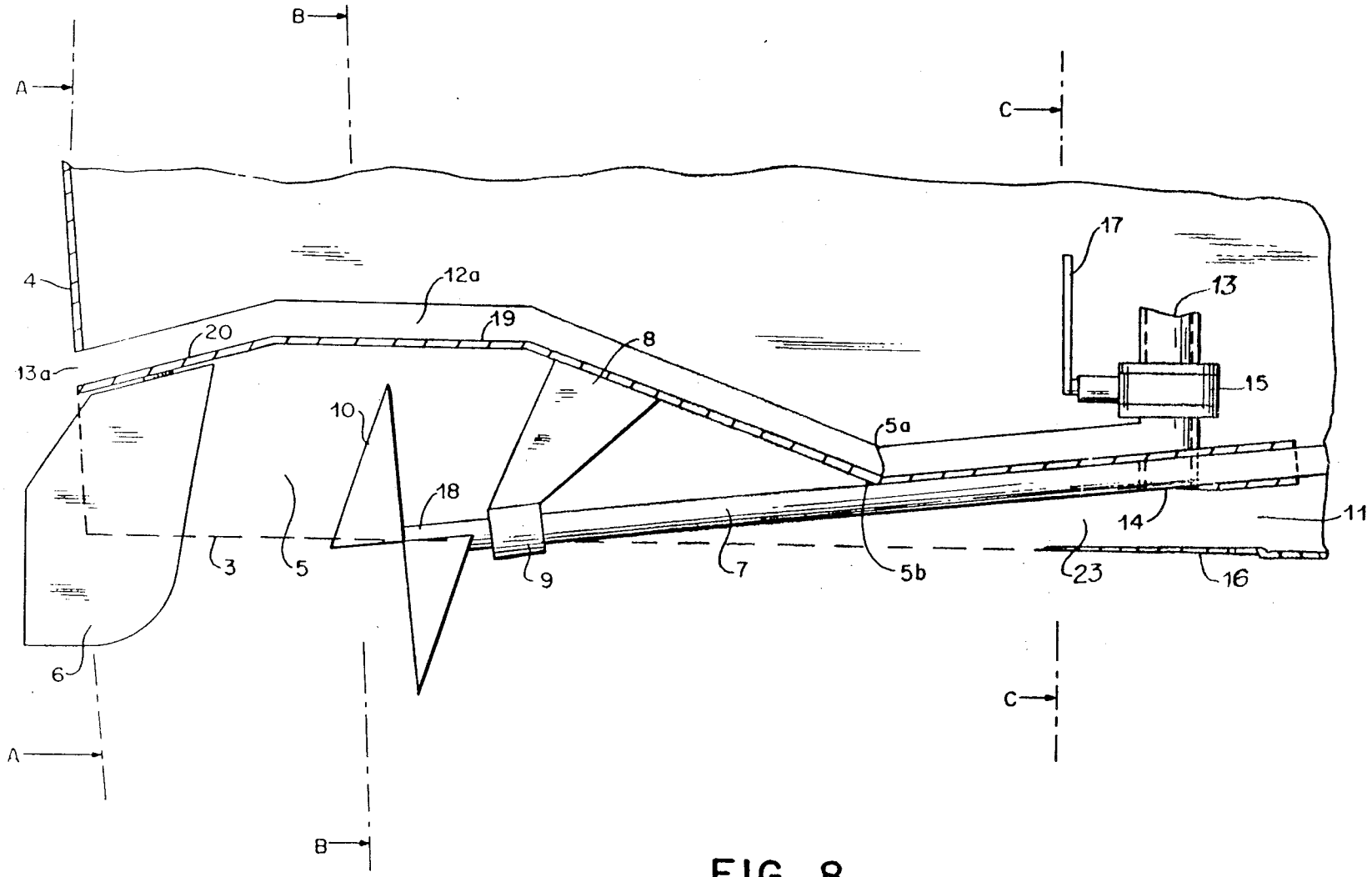
FIG. 8 is a partial sectional view, corresponding to the tunnel design of FIG. 2, illustrating another preferred embodiment of a tunnel and air delivery arrangement according to the present invention.

FIG. 8 illustrates another preferred embodiment of the present invention, particularly as respects the supply of air to the tunnel forward of the propeller. FIG. 8 illustrates a system involving multiple air inlets and ducts, one of which, air inlet 13*a*, is located in the transom 4 and through which air is admitted to the air duct 12*a*. In FIG. 8, the air duct 12*a* is located above and in juxtaposition with the roof 20 (aft of the propeller 10), 19 (in the area of the propeller), and 5*b* (forward of the propeller) of the tunnel 5. The air duct 12*a* continues forward along the roof of the tunnel until it joins another air duct 12. Air duct 12 conveys air admitted at a second air inlet, 13. Air from both sources, air ducts 12 and 12*a*, is combined and enters the tunnel 5 at air outlet 14.

Both FIGS. 7 and 8 illustrate different air supply configurations whereby air may be brought into the tunnel 5 forward of the propeller 10. It has been found according to the present invention that a principal requirement is that the volume of air to be admitted to the tunnel be sufficient to achieve the purposes of the invention; for example, suppression of the water level in the tunnel for efficient operation of the surface-piercing propeller and suppression of the spray admitted at the transom end of the tunnel. Depending upon such factors as the size, speed, and function of the vessel, the amount of air required to properly ventilate the tunnel may differ from vessel to vessel.

Accordingly, the present invention contemplates that the air supply configuration may be highly flexible. For example, the size, number, and location of the air inlets may be varied depending upon the amount of air required and the external and internal configuration of the boat. FIG. 8, for example, contemplates an air supply air arrangement using two sources of air, one from the stern via air inlet 13*a* and the other from elsewhere on the vessel via air inlet 13. The arrangement in FIG. 8 may or may not provide for a greater supply of air to the tunnel than that illustrated in FIG. 7, depending upon, for example, the size of the air ducts 12 and 12*a*, and the corresponding air inlets 13 and 13*a*. It has been found that the shortest and most direct means of transporting air to the tunnel is more efficient, not only in terms of the air supply itself but also because of the need to conserve or make use of scarce space within the vessel. However, providing the necessary volume of air is paramount and, as long as that air is admitted to the tunnel forward of the propeller, any arrangement that is satisfactory for that purpose is contemplated by the present invention.

Figure 9:
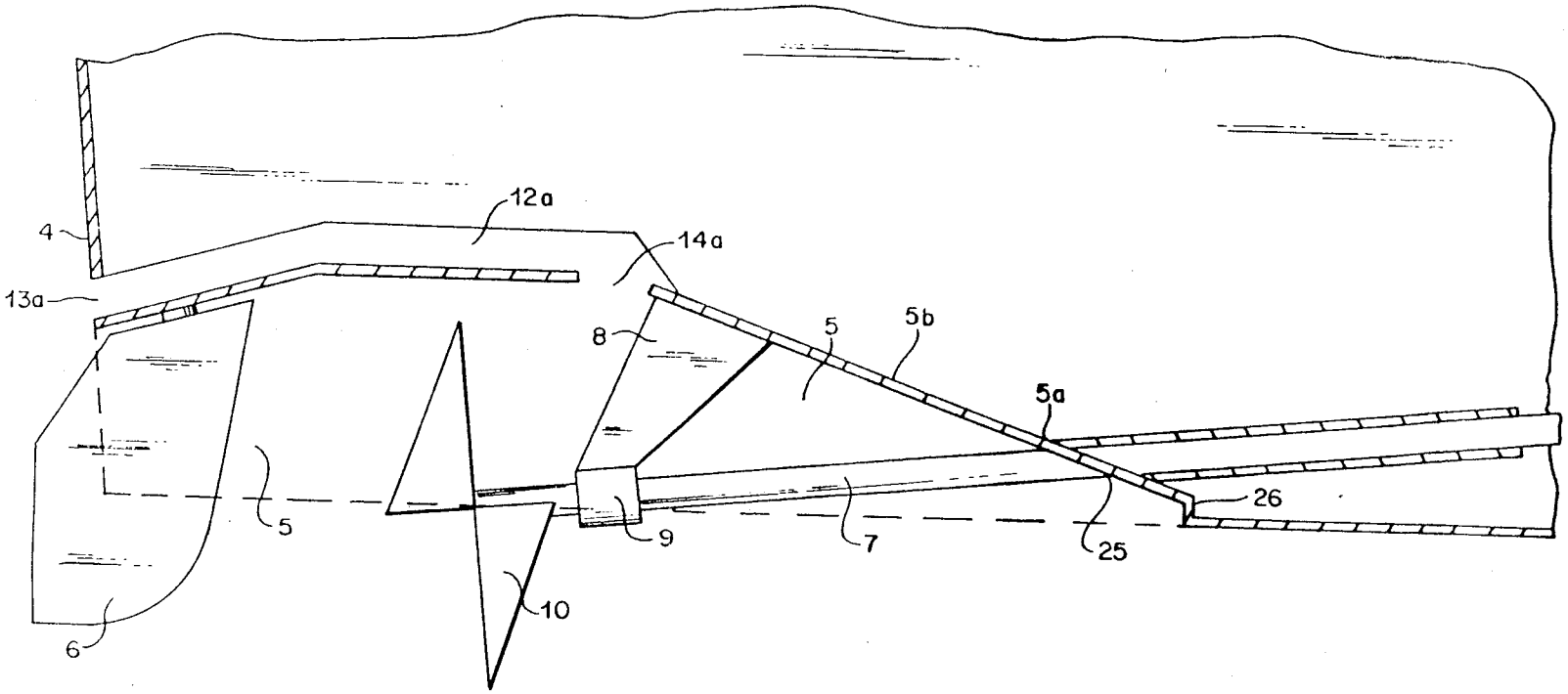
FIG. 9 is a partial sectional view, corresponding to the tunnel design of FIG. 3, illustrating another preferred embodiment of a tunnel and air delivery arrangement according to the present invention.

FIG. 9 illustrates another configuration of the air supply, similar to that illustrated in FIG. 7, but used in respect to the tunnel configuration illustrated in FIG. 3. In the preferred embodiment of FIG. 9, air is admitted at air inlet 13*a*, passes through air duct 12*a*, and is admitted to the tunnel 5 at air outlet 14*a*. In this embodiment, as in that shown in FIG. 7, augmentation of the air supply from the transom of the vessel by a second air inlet/duct arrangement is unnecessary.

Figure 10:
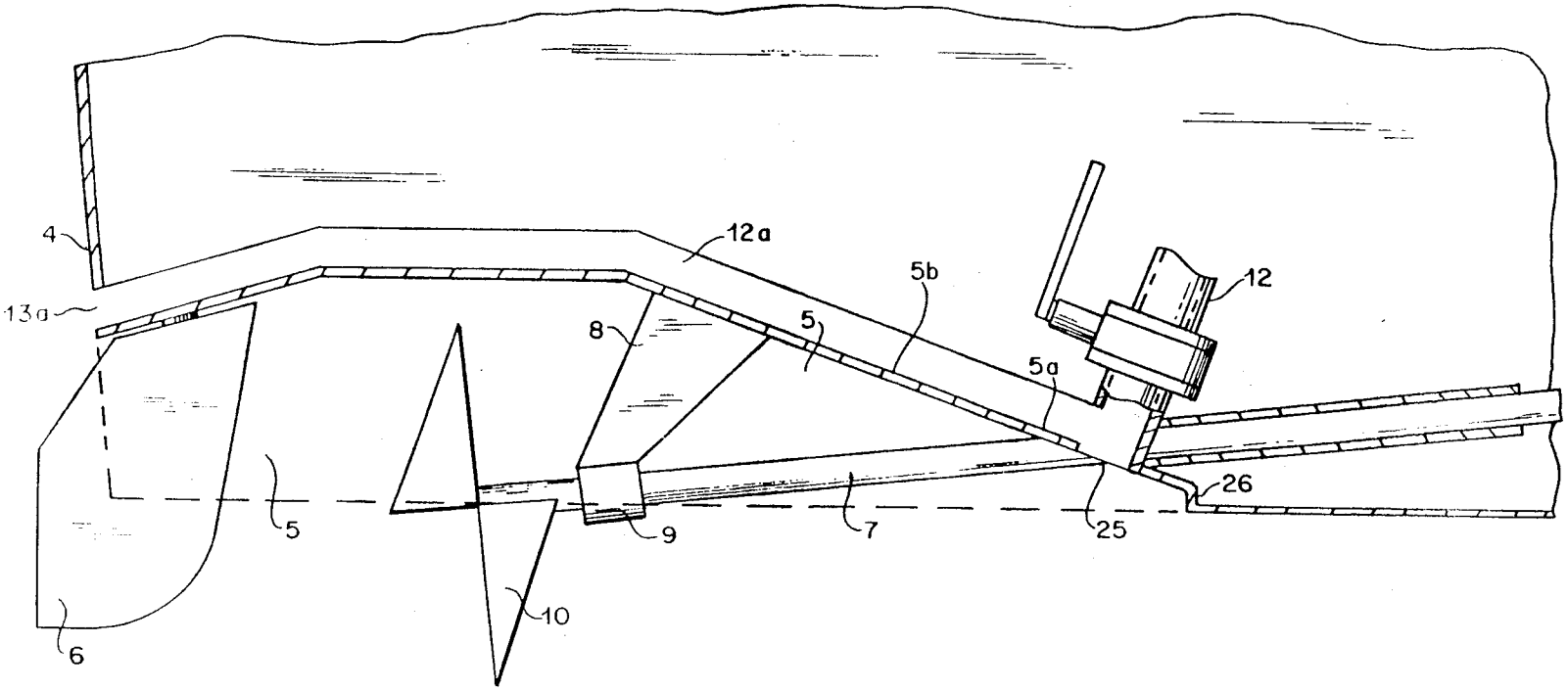
FIG. 10 is a partial sectional view, corresponding to the tunnel design of FIG. 3, illustrating another preferred embodiment of a tunnel and air delivery arrangement according to the present invention.

FIG. 10 represents an air supply arrangement corresponding to that shown in FIG. 8, in conjunction with a tunnel configured as in FIG. 3. FIG. 10 illustrates a dual air supply, in which the air admitted at the transom through air inlet 13*a* is combined with that admitted elsewhere on the vessel and passing through duct 12. The combined air is admitted at air outlet 25 to the tunnel 5 forward of the propeller 10.

Figure 11:
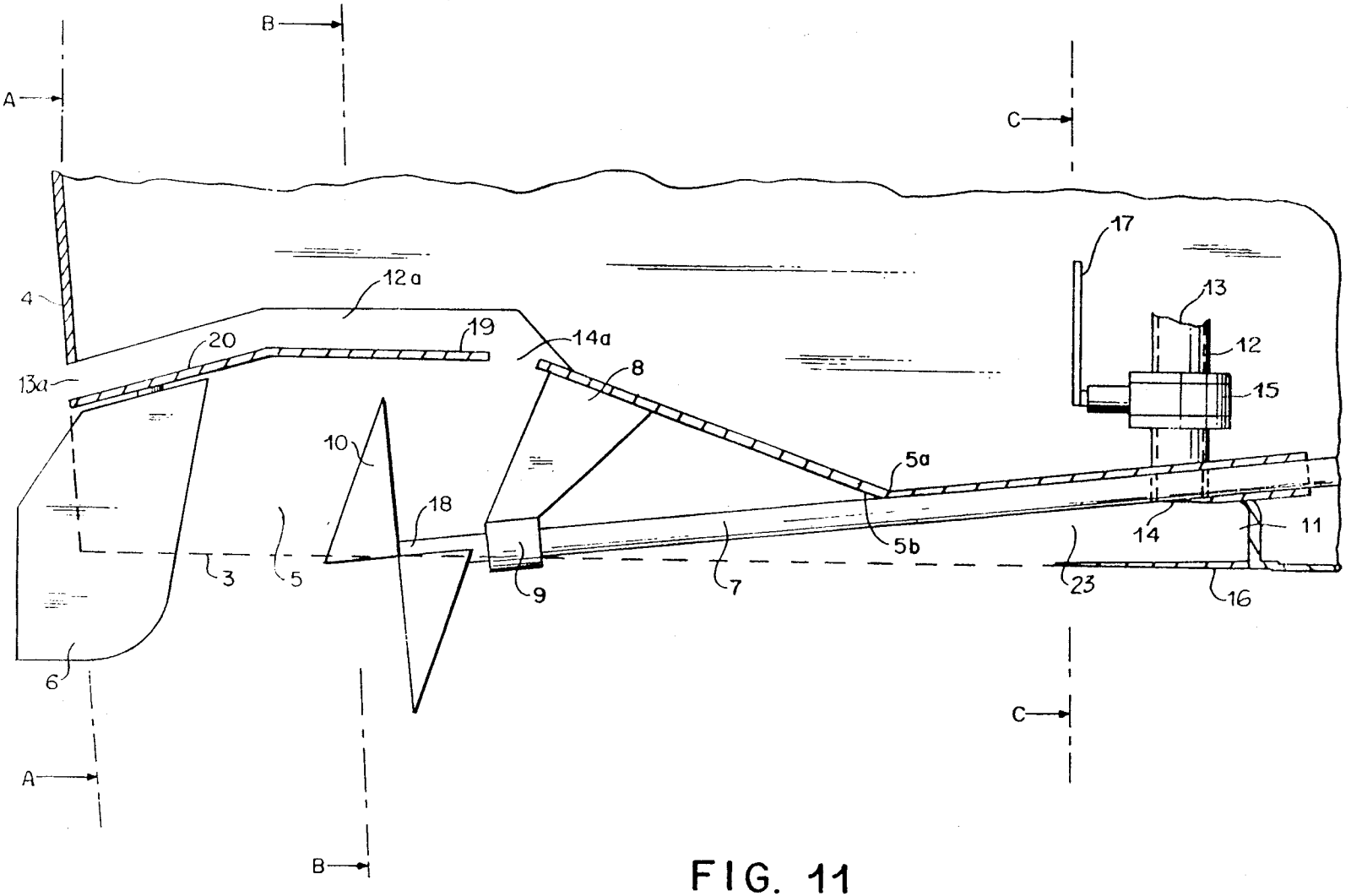
FIG. 11 is a partial sectional view, corresponding to the tunnel design of FIG. 2, illustrating another preferred embodiment of a tunnel and air delivery arrangement according to the present invention.

FIG. 11 illustrates another embodiment of the air supply arrangement of the present invention. The basic configuration of the tunnel 5 of FIG. 11 is that of FIG. 2. The particular embodiment of the air supply of FIG. 11 in part corresponds to that of FIG. 7, but the air admitted at air inlet 13*a*, passing through air duct 12*a*, and admitted to the tunnel 5 at air outlet opening 14*a*, is augmented by a separate air supply arrangement, consisting of air inlet 13, air duct 12 and a separate air outlet opening 14 into the tunnel. FIG. 11 therefore illustrates an air supply arrangement involving two separate air inlet, air duct and air outlet systems.

Figure 12:
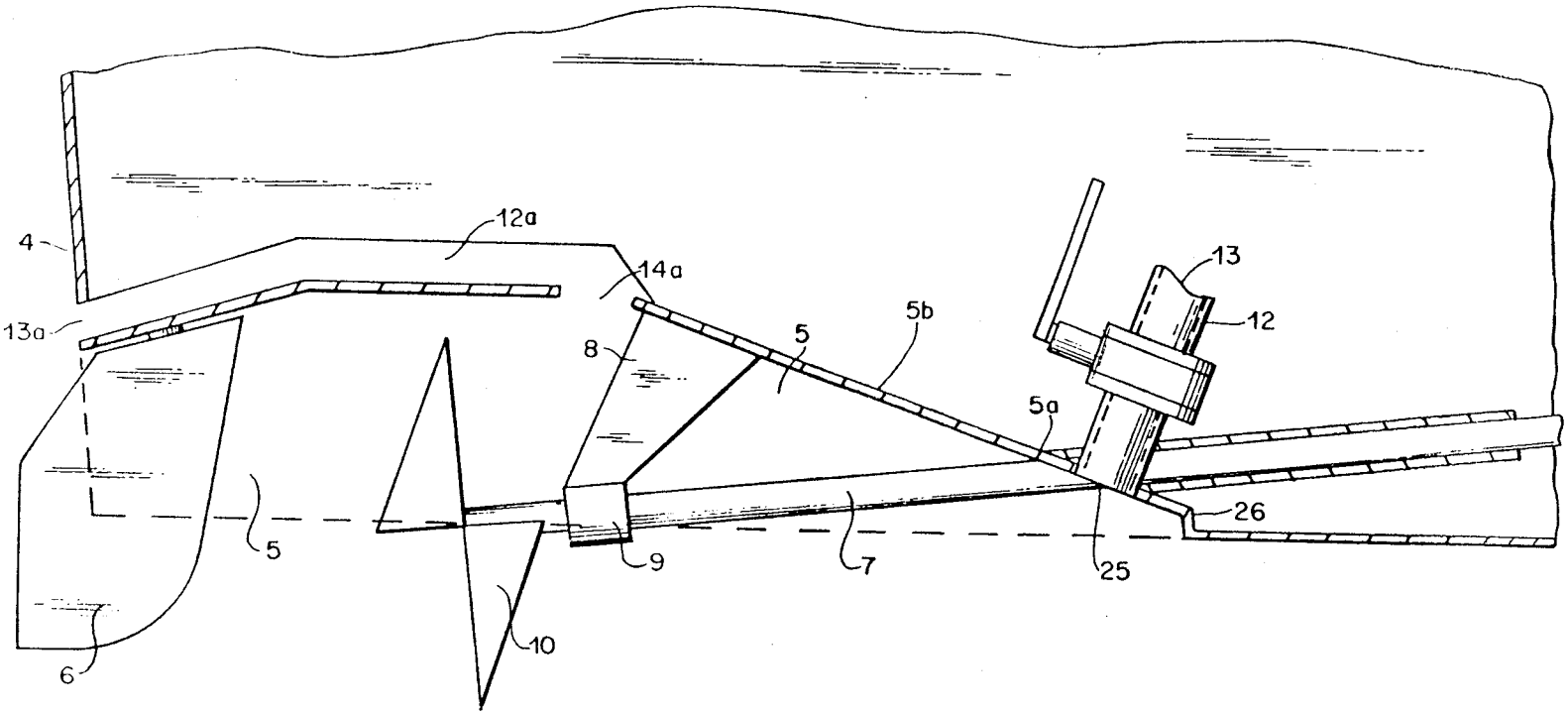
FIG. 12 is a partial sectional view, corresponding to the tunnel design of FIG. 3, illustrating another preferred embodiment of a tunnel and air delivery arrangement according to the present invention.

FIG. 12 illustrates an air supply arrangement of the present invention which is the counterpart of that illustrated in FIG. 11 but which is used in conjunction with a tunnel configured as in FIG. 3. As in FIG. 11, air is admitted at air inlet 13*a*, passes through duct 12*a*, and is admitted to the tunnel 5 forward of the propeller at air outlet opening 14*a*. The latter air supply arrangement is paired with a separate system, consisting of air inlet 13, duct 12, and air outlet 25. In this configuration, as in that illustrated in FIG. 11, there are two air outlet openings into the tunnel 5, but the present invention contemplates that there may be more than two such openings, and separate air supply arrangements, depending upon the volume of air needed for the particular tunnel(s).

Figure 13:
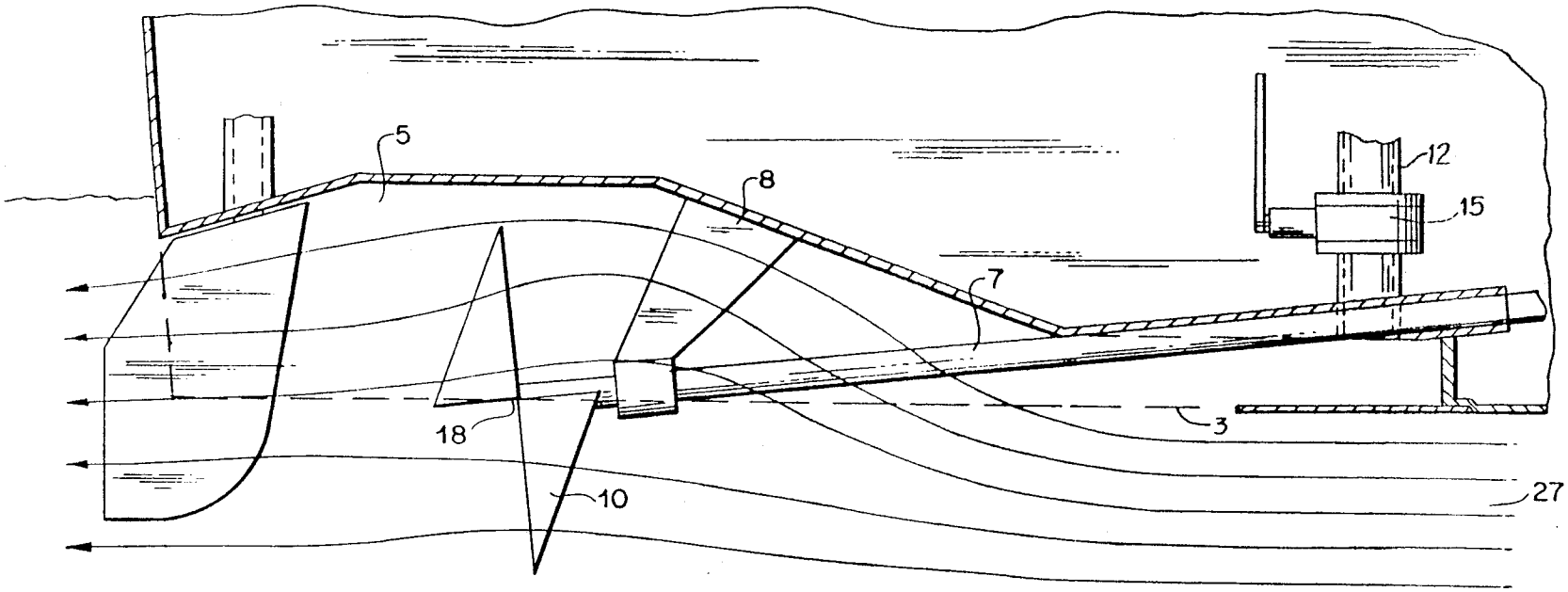
FIG. 13 is a partial sectional view, corresponding to the showing of FIG. 2, illustrating typical water flow lines in a tunnel with air intake valves closed.
Figure 14:
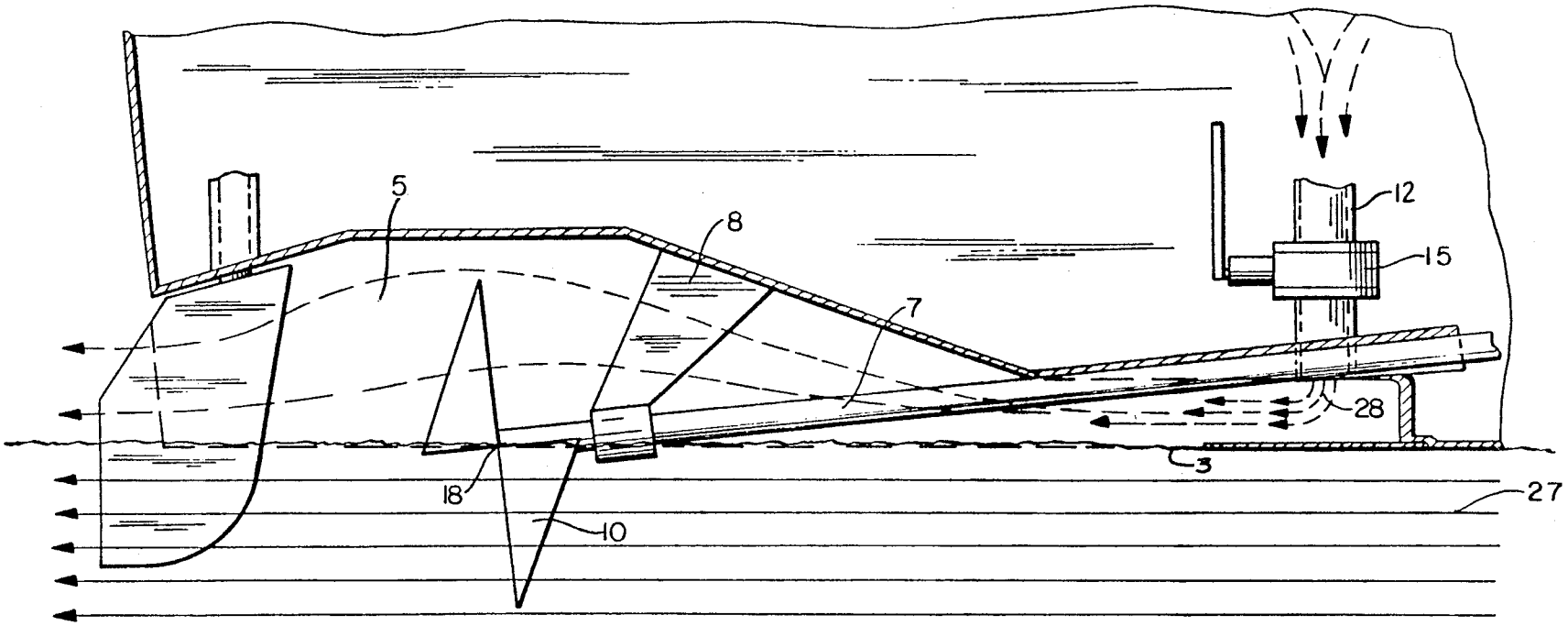
FIG. 14 is a partial sectional view, corresponding to the showing of FIG. 2, illustrating typical water flow lines in a tunnel with air intake, valves open.

FIGS. 13 and 14 show the effect upon water-flow in a tunnel configured as in FIG. 2 in an embodiment of the present invention with a single valve-controlled air supply arrangement when the air intake valve is open or closed. In FIG. 13, wherein the vessel is at pre-planing speed and the valve 15 is closed, no air is admitted via the duct 12 to the tunnel forward of the propeller 10. In this condition, the water 27 flowing into the tunnel rises above the bottom of the hull 3 and fills the tunnel. The propeller 10 is therefore completely submerged for the most efficient operation at this speed. In FIG. 14, wherein the valve 15 of air duct 12 is open and air 28 is admitted to the tunnel 5, the water 27 in the tunnel does not rise above the level of the bottom of the hull 3 of the vessel. In the circumstances illustrated by FIG. 14, wherein the vessel is at planing speed, the tunnel is only partially filled with water and the surface-piercing propeller 10 is half-submerged for the most efficient operation at planing speed. FIGS. 13 and 14 reflect the embodiment of the invention reflected by FIG. 2, but the principles of water flow and propeller submergence demonstrated by FIGS. 13 and 14 apply equally to the tunnel configuration illustrated by FIG. 3, as well as to all other air supply embodiments contemplated by the present invention.

Figure 15:
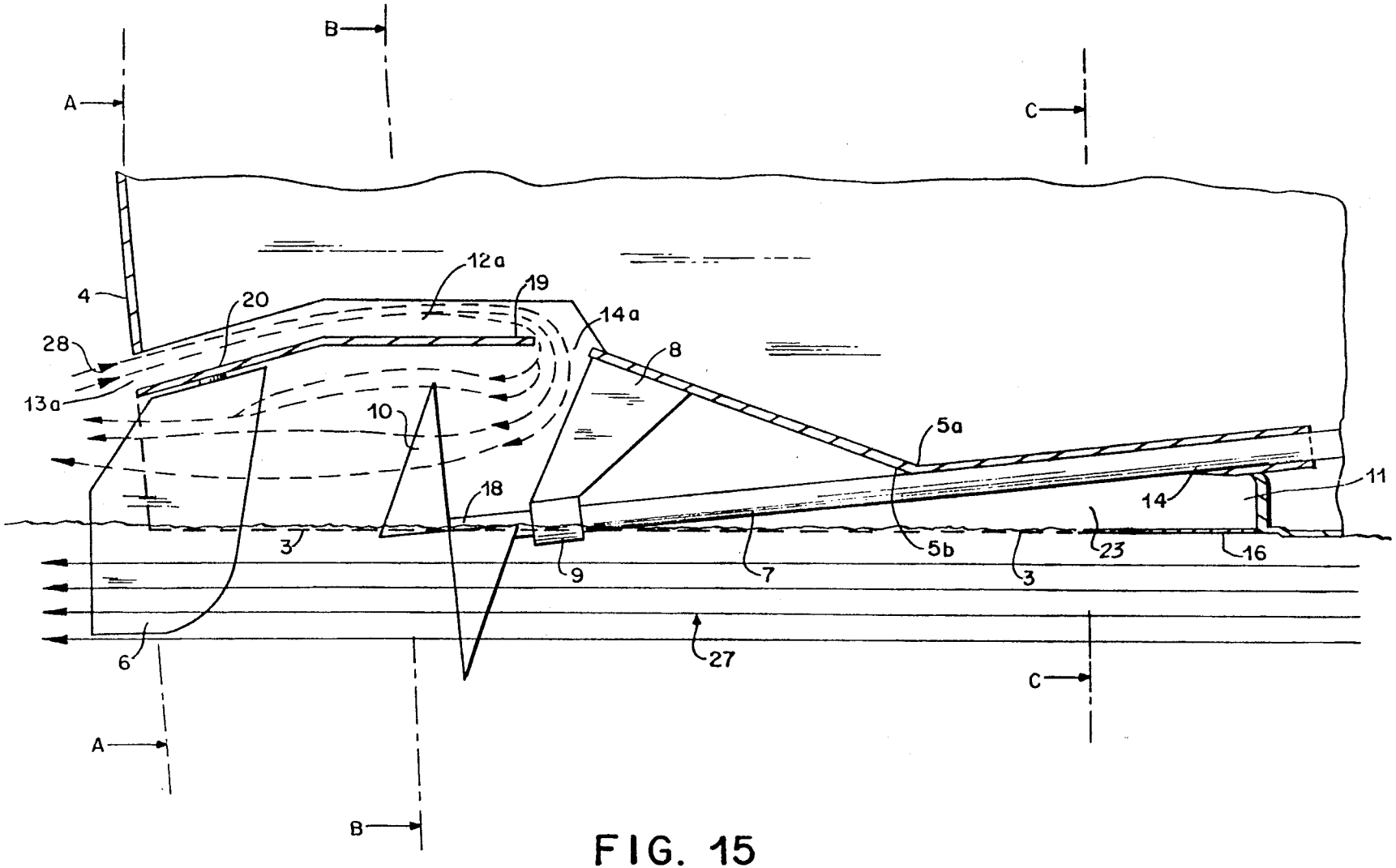
FIG. 15 is a partial sectional view, corresponding to the showing of FIG. 7, illustrating typical water flow lines in a tunnel with a valveless air delivery arrangement wherein the vessel is at planing speed.

FIG. 15 illustrates the general principles of air flow described in connection with FIGS. 13 and 14 but in connection with a system involving the supply of air to the tunnel from the transom only. FIG. 15 illustrates a vessel, at planing speed, equipped with the air supply arrangement illustrated in FIG. 7, wherein air 28 is admitted at air inlet 13*a*, located in the transom of the vessel just above (but separated from) tunnel 5, is conveyed through air duct 12*a*, and enters the tunnel 5 forward of the propeller 10 at air outlet 14*a*. In this configuration, only one air supply and air outlet into the tunnel is contemplated. It will be seen in FIG. 15 that the flow pattern of air 28 is similar to that illustrated in FIG. 14, although it is admitted further aft in the tunnel 5 (although still forward of the propeller) and therefore does not traverse as much of the tunnel 5 as does the air admitted to the tunnel in FIG. 14. The effect, however, is the same; namely, to suppress the level of the water 27 in the tunnel so that it does not rise above the level of the bottom 3 of the vessel. As already stated, in such an arrangement, above planing speed, the flow of air into the tunnel 5 appears to be proportional to the speed of the boat, a condition believed to be caused by the creation of a partial vacuum in the tunnel 5 into which the air 28 flows.

Figure 16:
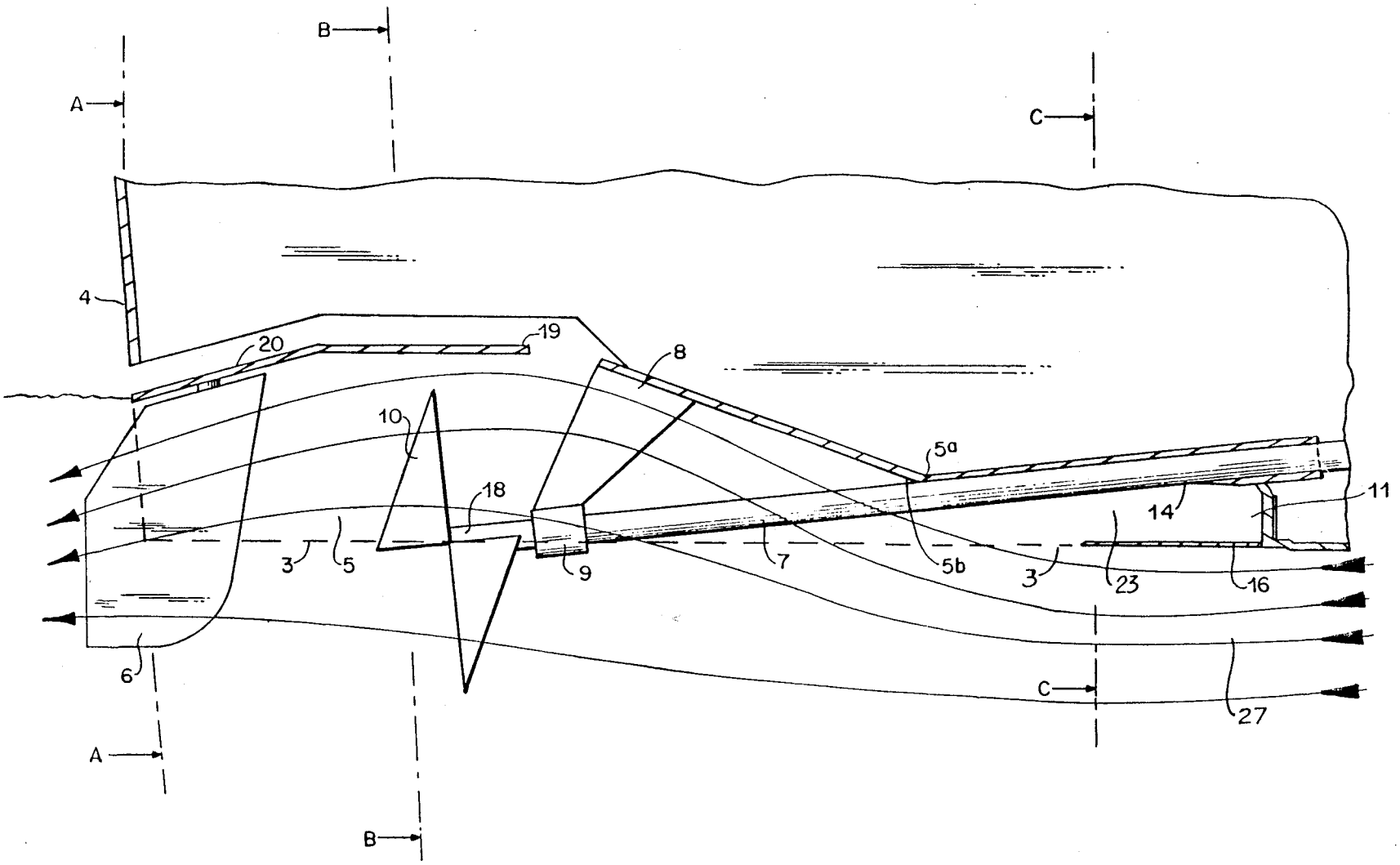
FIG. 16 is a partial sectional view, corresponding to the showing of FIG. 7, illustrating typical water flow lines in a tunnel with a valveless air delivery arrangement when the vessel is below planing speed.

FIG. 16 illustrates the embodiment of the invention shown in FIG. 15, but with the vessel below planing speed and without air being admitted to the tunnel forward of the propeller. In this condition, it will be seen that the water 27 flows into and completely fills the tunnel 5. Because the forward motion of the vessel below planing speed is insufficient to create a vacuum in the tunnel, and thereby to admit air, no air is admitted to the tunnel forward of the propeller 10 and the surface-piercing propeller, as is most efficient below planing speed, is operating completely submerged.

Figure 17:
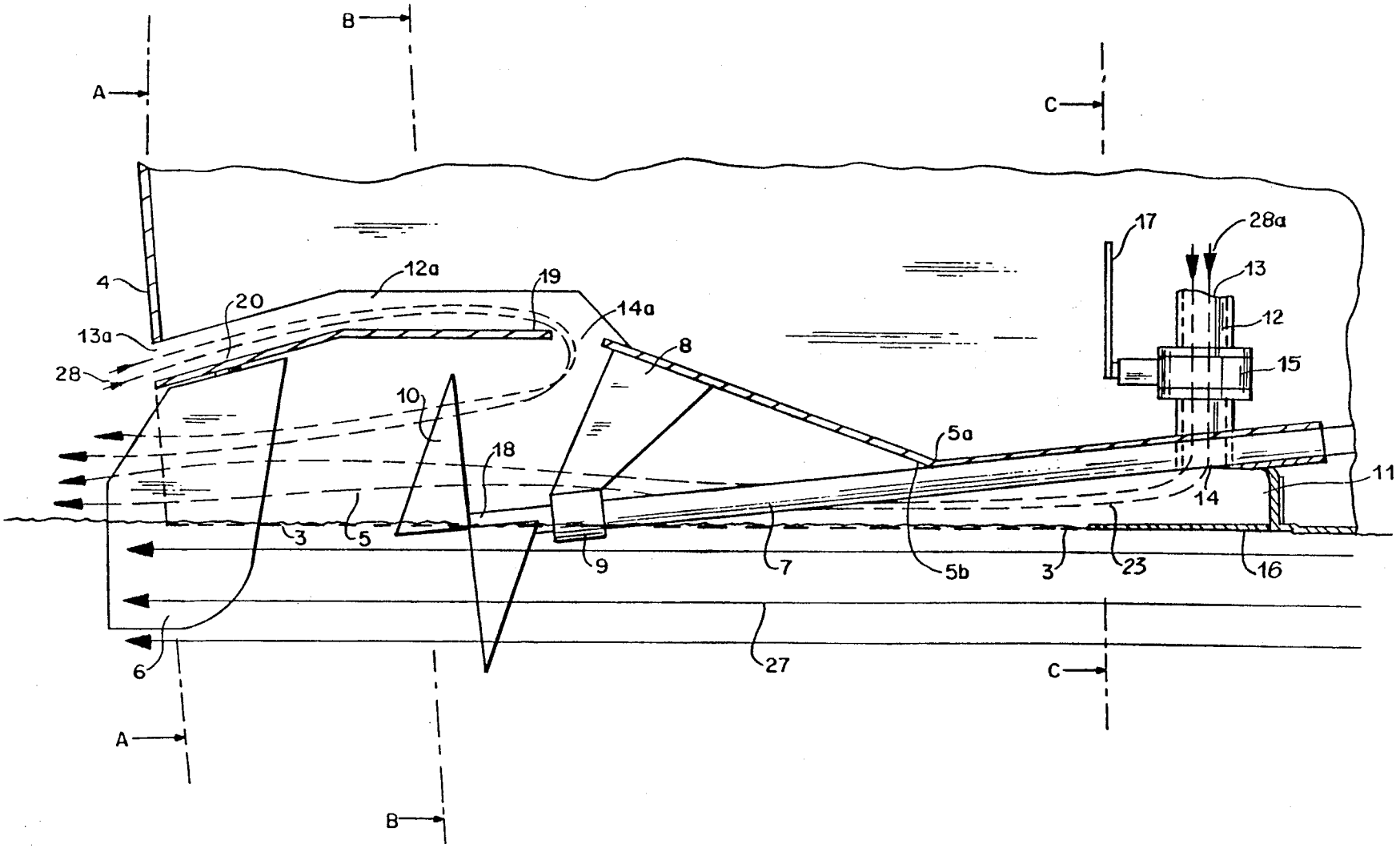
FIG. 17 is a partial sectional view, corresponding to the showing of FIG. 11, illustrating typical water flow lines in a tunnel wherein the vessel is at planing speed with valves open.

FIG. 17 illustrates air and water flow in a tunnel and with an air supply arrangement of the type illustrated in FIG. 11. In FIG. 17, the vessel is at planing speed and air 28 is admitted at inlet 13*a* from the transom of the vessel. The transom air 28, having passed through air duct 12*a*, passes into the tunnel 5 at air outlet 14*a*. Air 28*a* is also admitted via forward air inlet 13 through air duct 12 and into the tunnel 5 at air outlet 14. The forward air supply 28*a* is controllable by valve 15. FIG. 17 shows that at planing speed the level of water 27 in the tunnel 5 does not rise above the level 3 of the bottom of the vessel and the air 28 and 28*a* fills the tunnel above the level of the water 27. The surface-piercing propeller 10 is operating half-submerged, for optimum efficiency and performance at planing speed. The specific dynamics and pattern of the air flow in a tunnel with such a dual air supply system as that illustrated in FIG. 17 are not precisely understood, although it is believed that FIG. 17 is illustrative. It is known, however, that the air supply and flow from such a system is satisfactory for the purposes of the present invention. Again, FIG. 17 illustrates that as long as there is an adequate supply of air to the tunnel forward of the propeller, the specific origin of that air is unimportant to the final result; namely, that at planing speed the air will be drawn into and fill the upper one-half of the tunnel, thereby suppressing the water level, which remains below the midpoint of the tunnel.

Figure 18:
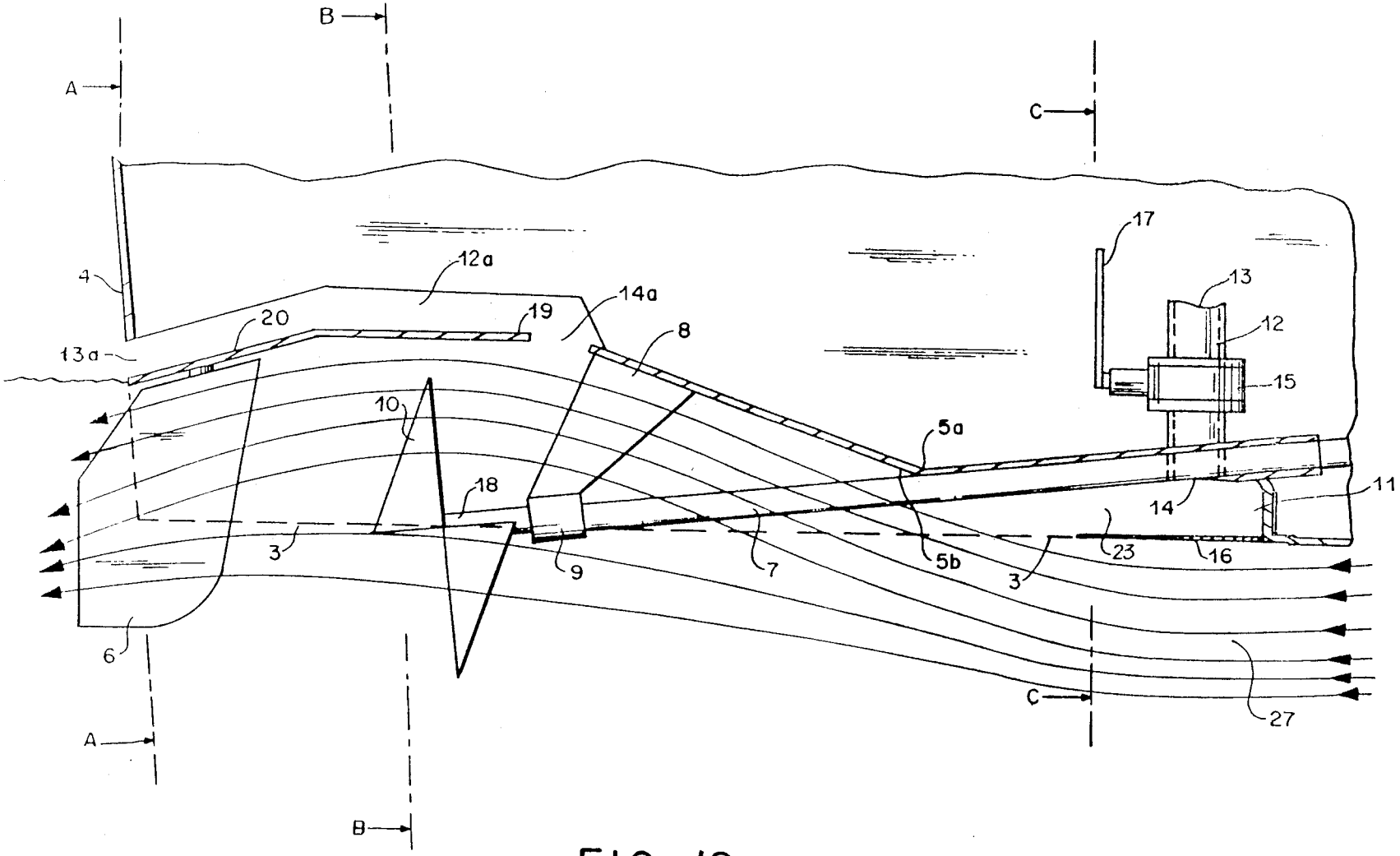
FIG. 18 is a partial section view, corresponding to the showing of FIG. 11, illustrating typical water flow lines in a tunnel wherein the vessel is below planing speed with the valves closed.

FIG. 18 illustrates the tunnel and air supply arrangement of FIG. 17 wherein the vessel is below planing speed and air is not drawn into the tunnel. In this circumstance, the water 27 flows into and completely fills the tunnel 5. The propeller 10 is therefore operating fully submerged, an optimally efficient condition at subplaning speeds.

Figure 19:
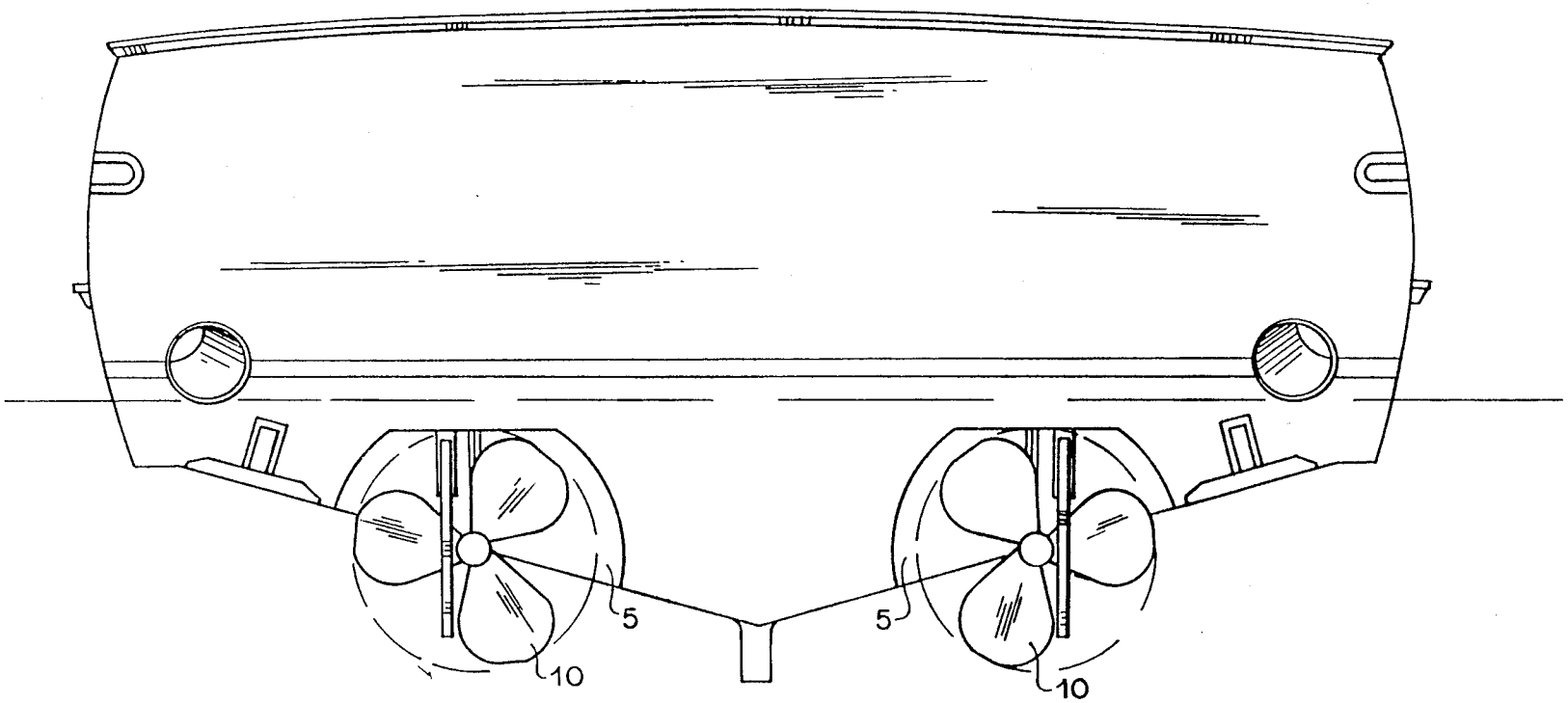
FIG. 19 is a rear view of a marine vessel configured with two tunnels and two propeller assemblies.

FIG. 19 illustrates the transom of a typical two-tunnel vessel with which the present invention is to be used. In this configuration, the twin tunnels 5 and the twin surface-piercing propellers 10 are seen, but there is no air intake(s) located on the transom. Such intakes are located forward on the vessel, as illustrated in FIG. 1, wherein a starboard air intake 13 of such an air supply system is shown.

Figure 20:
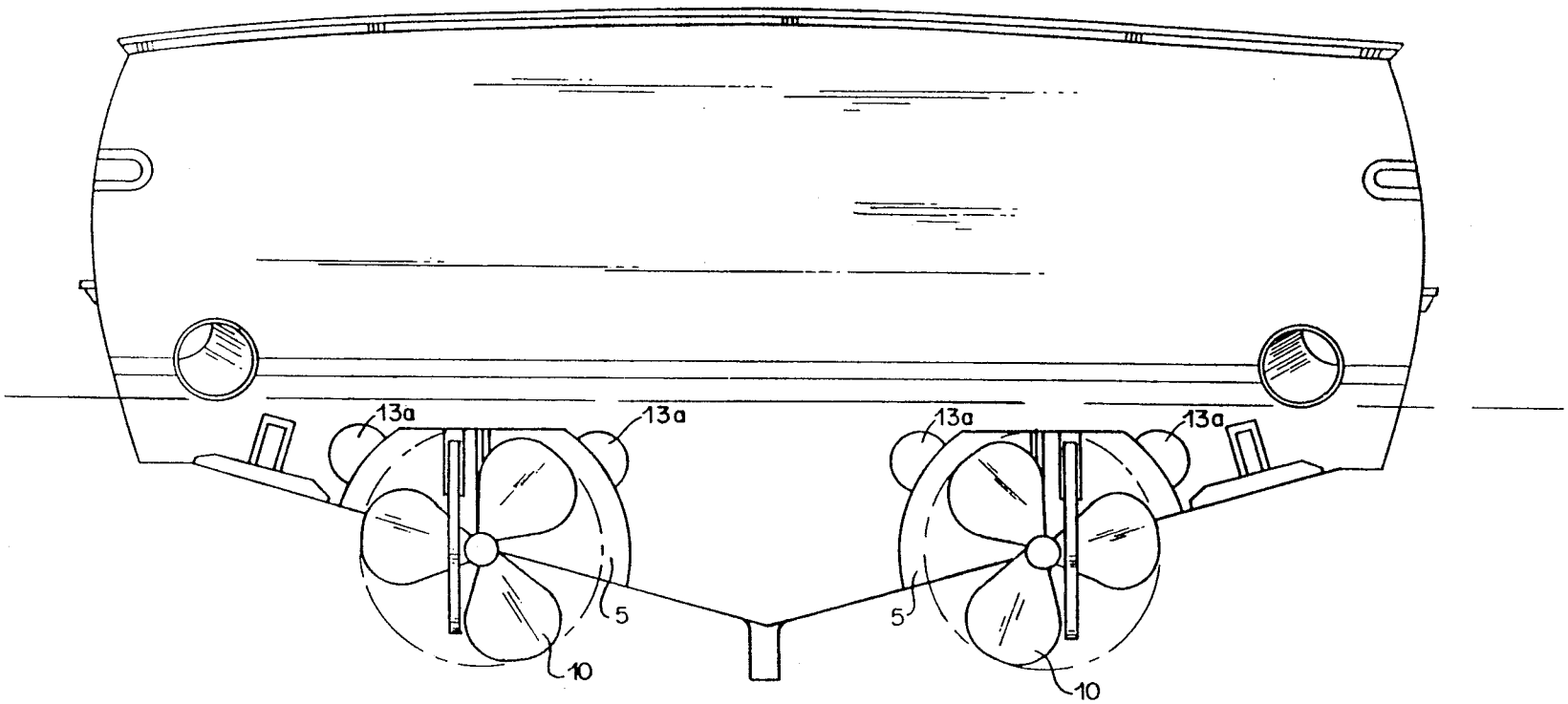
FIG. 20 is a rear view of a marine vessel, corresponding to the showing of FIG. 19, illustrating a preferred embodiment of an air intake arrangement according to the present invention.

FIG. 20 shows the transom of the same type of vessel as illustrated in FIG. 19, except that in this configuration each tunnel 5 is surmounted by two air intakes 13*a*. It will be seen that air intakes 13*a* are peripheral to, but not part of, each of the twin tunnels 5. Air entering air intakes 13*a* is ducted to each tunnel forward of the propeller, as is illustrated in, for example, FIGS. 7, 8, and 9.

Figure 21:
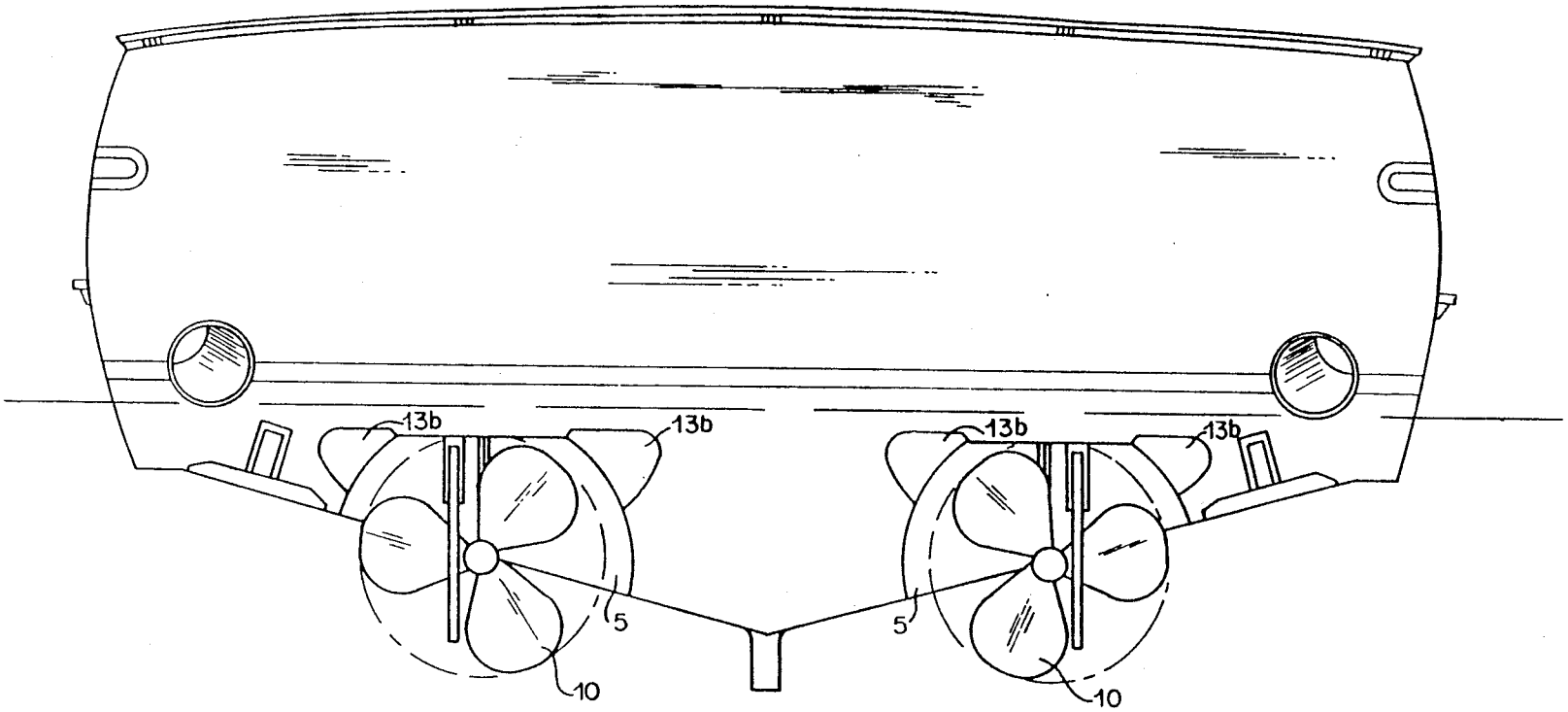
FIG. 21 is a rear view of a marine vessel, corresponding to the showing of FIG. 19, illustrating a further preferred embodiment of an air intake arrangement according to the present invention.

FIG. 21 illustrates the transom of a vessel identical to that shown in FIGS. 19 and 20, except that the air intakes 13*b* are of a different configuration than those shown in FIG. 20. Air intakes 13*b* of FIG. 21 are somewhat more elongated than air intakes 13*a* of FIG. 20. The different configuration of air intakes 13*b* may be required where, for example, more air is required to be provided to the tunnels 5 or where the configuration of the transom or of the interior of the vessel requires that the air intakes and/or air supply ducts be of a different shape. It will be understood that the particular configuration of the air intakes and the air supply ducts is controlled by such functional aspects, as long as an adequate supply of air to the tunnel(s) is assured. Locating the air intakes at the transom above and surrounding the tunnel(s) has been found to be particularly advantageous, in that an adequate air supply is provided to the tunnel and the location of the air intakes and ducts is particularly practical and efficient in that it takes particular advantage of the configuration of the exterior and interior of the vessel and is in many manifestations shorter and less complicated.

Figure 22:
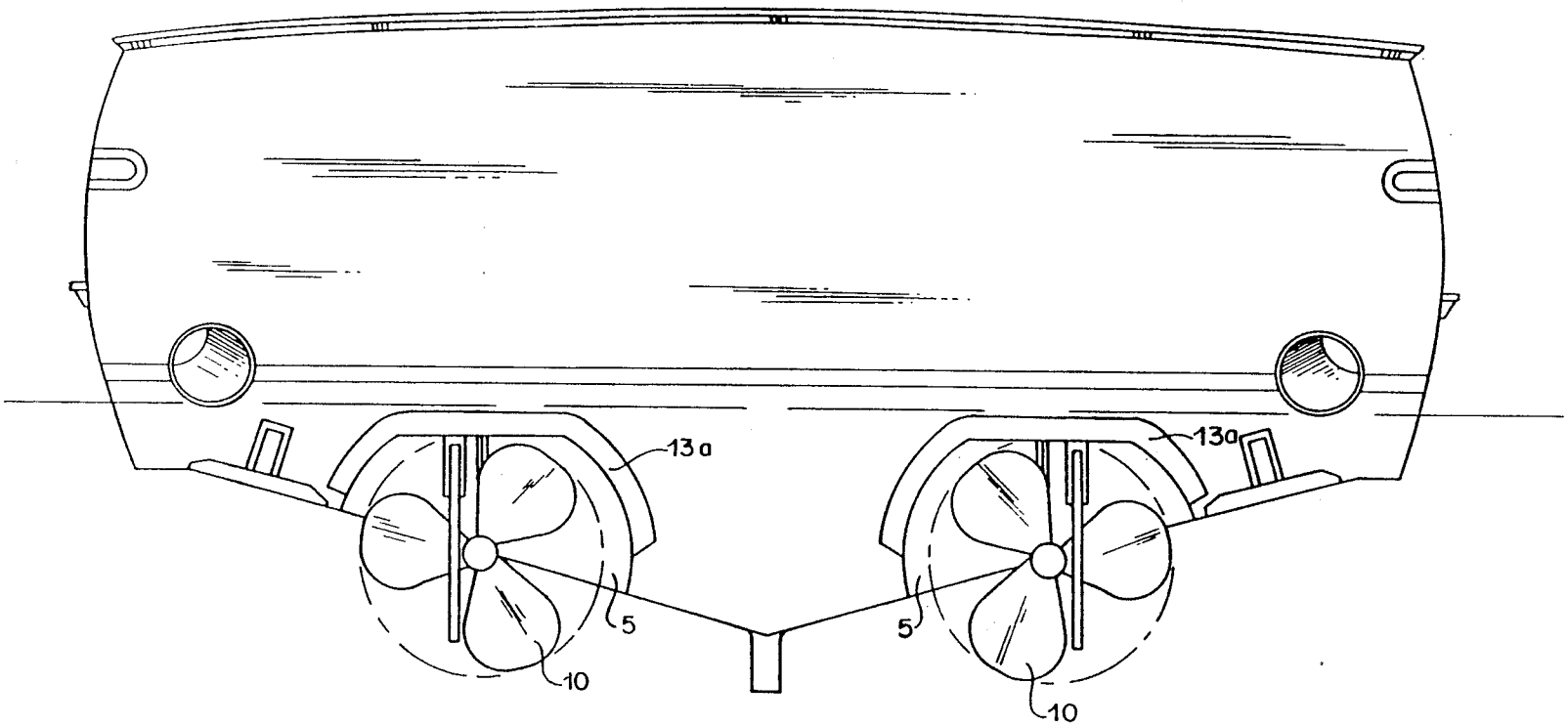
FIG. 22 is a rear view of a marine vessel, corresponding to the showing of FIG. 19, illustrating a further preferred embodiment of an air intake arrangement according to the present invention.

FIG. 22 illustrates another variation on the transom-located air intakes previously described in connection with FIGS. 20 and 21. In this embodiment, one air intake, 13*a*, surrounds each of tunnels 5. Air intakes 13*a*, as shown in FIG. 22, are each connected to internally-located air ducts of a shape suitable to convey the air drawn in at intakes 13*a* to each tunnel forward of the propeller. The configuration of such a duct may or may not be identical to that of the external air intake opening, depending upon its ability to convey the necessary volume of air to the tunnel.

It is not necessary that in the embodiment of the present invention illustrated by FIG. 22, or in other embodiments in which there are more than one air inlet, that each such inlet be separately connected to its own air duct. For reasons such as the configuration of the vessel, the volume of air required, and the like, it may be necessary that multiple air inlets be connected to a single air duct. Conversely, a single air duct might be connected to an air duct which divides into multiple passages.

It is to be understood that for convenience and simplicity of description, many embodiments of the present invention in the above specification have been described in the singular. The invention is not so limited, however, because it contemplates one or more tunnels, one or more air inlets, air supply ducts, air outlets, surface-piercing propellers, and the like, depending upon requirements imposed by, for example, the size and geometry of the vessel, the necessary air supply, and desired performance.

The manner of operation of the propulsion system of the present invention will now be described.

In all embodiments of the present invention, at speeds below that at which planing operation is achieved, the tunnel is fully flooded and the surface-piercing propeller is operating fully submerged. Such a condition is illustrated in FIGS. 13, 16 and 18 and represents the optimum operating condition for the surface-piercing propeller at sub-planing speeds.

As engine power is increased, planing speed is achieved. At this stage, air is admitted to the tunnel. It has been found that once a vessel equipped with the present invention has achieved planing speed, air is automatically drawn into the tunnel forward of the propeller. If the air supply system, air intakes, ducts, and air outlets into the tunnel provide for the passage of a sufficient volume of air, the tunnel will be properly ventilated, the water level suppressed, propeller-generated spray largely eliminated, and, in general, the purposes of the invention will be achieved. The embodiment illustrated in FIGS. 7 and 9, and consisting merely of an air inlet, duct and outlet is, for reasons of simple and efficient construction, preferable in that the volume of air admitted to the tunnel is self-regulated by the speed of the vessel and other devices, such as valves and controls, are not needed.

Other embodiments of this invention, however, provide for operator-controlled operation, in whole or in part, of the air supply. Such systems may provide additional flexibility and a greater degree of control over the operation of the vessel. Such a controlled system is illustrated in FIGS. 2 and 3, wherein the air supply is regulated by manually (or machine-) operated valves, whereby the flow of air to the tunnel 5 forward of the propeller 10 may be controlled by a crewmember, wholly apart from the speed of the vessel. A hybrid air-supply system is illustrated in FIGS. 8, 10, 11 and 12, wherein the operator-controlled air supply may be supplemental (FIGS. 11 and 12) to an essentially independent air supply controlled by the speed of the vessel or joined with the latter air supply (FIGS. 8 and 10) to provide a single point of air supply to the tunnel 5. It is contemplated that in the latter embodiments, whereby a self-regulating and operator-controlled air supply are both incorporated, the operator-controlled air supply system may be put into operation when additional air is required. Such an embodiment may be used, for example, when the configuration of the vessel requires it or a higher degree of operating efficiency is required. In embodiments which include an operator-controlled air supply system, it is contemplated that such a system may be operated as a self-regulating air supply, in that, as shown in FIG. 11, the valve 15 may be left open and the volume of air flowing through the forward air duct 12 into the tunnel 5, as well as that flowing through the aft air duct, 12*a*, will be controlled by the speed of the vessel.

In an embodiment of the present invention employing a valve-controlled or—equipped air intake system, as shown, for example, in FIGS. 2, 8, and 11, and if operator control of the air supply is desired, it is contemplated that once planing speed has been reached, as will be apparent from FIG. 14, the air intake valve 15 is opened and air 28 is admitted to the tunnel 5. A free water surface above the line of the bottom of the hull 3 is thereby created in the tunnel 5, which intercepts the propeller 10 at approximately its centerline 18. In that mode, the propeller is operating half in and half out of the water, that is, in a condition of maximum efficiency for a surface-piercing propeller operating at planning speed. Also in this mode, the propeller shaft 7, strut 8, and tunnel 5 are operating in air, thereby leading to significant drag reductions and an increase in overall operating efficiency. A similar increase in efficiency is, of course, to be found when a vessel equipped with a self-regulatory air supply system of the present invention is operative at planing speed.

In a preferred embodiment of an operator-controlled air supply of the present invention, the degree to which the air intake valve is open is adjustable. As a result, the degree of submergence of the propeller may be controlled and the operating efficiency of the propeller at different speeds and vessel loadings increased.

As already stated, in those preferred embodiments of the present invention which do not include an operator-controlled air supply, the same effects are achieved, namely, a free water surface is created at the midpoint of the tunnel, so that the propeller can operate half submerged and the propeller shaft and the propeller strut can operate free of the water in the tunnel.

While the invention has been described in conjunction with preferred specific embodiments thereof, it will be understood that this description is intended to illustrate and not limit the scope of the invention, which is defined by the following claims.

Accordingly,

What I claim is:

1. An improved propulsion system for a powerboat of the type having a tunnel located on the exterior of the hull of the powerboat and a surface-piercing propeller within the tunnel, means for drawing air from the exterior of the powerboat by means other than the tunnel and conveying it to the tunnel, and means for admitting said air to the tunnel forward of the propeller, the improvement wherein:

the tunnel is of semi-circular cross-section in the vicinity of the propeller;

the radius of the tunnel in the vicinity of the propeller provides running clearance for the propeller;

the said semi-circular cross-sectional area of the tunnel in the vicinity of the propeller blends smoothly into the area of the tunnel located forwards and rearwards of the vicinity of the propeller;

the area of the tunnel located rearwards of the vicinity of the propeller is semi-circular in cross-section with a flattened top;

the area of the tunnel located rearwards of the vicinity of the propeller is fitted with a rudder;

the height of the tunnel rearwards of the vicinity of the propeller is constant for about one-half of the distance from the mid-point of the propeller to the transom;

the height of the tunnel in the rearward one-half of the area of the tunnel rearwards of the vicinity of the propeller gradually diminishes in a rearward direction;

the area of the tunnel forward of the vicinity of the propeller is semi-circular in cross-section, gradually changing to a rectangular cross-section at the forward end of the tunnel;

the height of the tunnel in the vicinity of the propeller is constant;

the height of the tunnel from a point forward of the vicinity of the propeller diminishes to the vicinity of the point at which the propeller shaft enters the tunnel;

the height of the tunnel forward of the point at which the propeller shaft enters the tunnel is constant;

the forward bottom underside of the tunnel consists of a flow separation plate; and air is admitted into the tunnel by an air outlet located on the roof of the tunnel forward of the propeller.

2. An improved propulsion system for a powerboat of the type having a tunnel located on the exterior of the hull of the powerboat and a surface-piercing propeller within the tunnel, means for drawing air from the exterior of the powerboat by means other than the tunnel and conveying it to the tunnel, and means for admitting said air to the tunnel forward of the propeller, the improvement wherein:

the tunnel is of semi-circular cross-section in the vicinity of the propeller;

the radius of the tunnel in the vicinity of the propeller provides running clearance for the propeller;

the said semi-circular cross-sectional area of the tunnel in the vicinity of the propeller blends smoothly into the area of the tunnel located forwards and rearwards of the vicinity of the propeller;

the area of the tunnel located rearwards of the vicinity of the propeller is semi-circular in cross-section with a flattened top;

the area of the tunnel located rearwards of the vicinity of the propeller is fitted with a rudder;

the height of the tunnel rearwards of the vicinity of the propeller is constant for about one-half of the distance from the mid-point of the propeller to the transom;

the height of the tunnel in the rearward one-half of the area of the tunnel rearwards of the vicinity of the propeller gradually diminishes in a rearward direction;

the area of the tunnel forward of the vicinity of the propeller is semi-circular in cross-section, gradually changing to a rectangular cross-section at the forward end of the tunnel;

the height of the tunnel forward of the vicinity of the propeller diminishes to a point approximately one inch above the bottom of the hull of the powerboat;

the forward end of the tunnel is a vertical wall approximately one inch in height; and air is admitted into the tunnel by an air outlet located in the roof of the tunnel rearward of said one-inch high vertical wall and forward of the propeller.

3. The propulsion system of claim 1 wherein the means for drawing the air into the tunnel and for conveying the air to and admitting it to the tunnel comprises: at least one air inlet opening located on the exterior hull of the powerboat; a duct, fitted with a valve to control the flow of air into the tunnel, connected to each said air inlet opening; and an air outlet opening connected to said duct and located in the tunnel forward of the propeller.

4. The propulsion system of claim 2 wherein the means for drawing air into the tunnel and for conveying the air to and admitting it to the tunnel comprises: at least one air inlet opening located on the exterior hull of the powerboat; a duct, fitted with a valve to control the flow of air into the tunnel, connected to each said air inlet opening; and an air outlet opening connected to said duct and located in the tunnel forward of the propeller.

5. The propulsion system of claim 3 wherein at least certain of the valves are variably adjustable from a remote location.

6. The propulsion system of claim 4 wherein at least certain of the valves are variably adjustable from a remote location.

7. The propulsion system of claim 3 wherein at least certain of the valves are variably adjustable.

8. The propulsion system of claim 4 wherein at least certain of the valves are variably adjustable.

9. The propulsion system of claim 7 wherein at least certain of the valves are variably adjustable from a remote location.

10. The propulsion system of claim 8 wherein at least certain of the valves are variably adjustable from a remote location.

11. The propulsion system of claim 3 wherein there is a plurality of ducts, at least certain of which are fitted with a valve to control the flow of air into the tunnel.

12. The propulsion system of claim 4 wherein there is a plurality of ducts, at least certain of which are fitted with a valve to control the flow of air into the tunnel.

13. The propulsion system of claim 11 wherein at least certain of the valves are variably adjustable.

14. The propulsion system of claim 12 wherein at least certain of the valves are variably adjustable.

15. The propulsion system of claim 13 wherein at least certain of the valves are variably adjustable from a remote location.

16. The propulsion system of claim 14 wherein at least certain of the valves are variably adjustable from a remote location.

17. The propulsion system of claim 1 wherein there are a plurality of tunnels.

18. The propulsion system of claim 2 wherein there are a plurality of tunnels.

19. The propulsion system of claim 17 wherein the means for drawing the air into the tunnels and for conveying the air to and admitting it to the tunnels comprises: at least one air inlet opening located on the exterior hull of the powerboat; a duct, fitted with a valve to control the flow of air into the tunnel, connected to each said air inlet opening; and an air outlet opening connected to said duct and located in the tunnel forward of the propeller.

20. The propulsion system of claim 18 wherein the means for drawing the air into the tunnels and for conveying the air to and admitting it to the tunnels comprises: at least one air inlet opening located on the exterior hull of the powerboat; a duct, fitted with a valve to control the flow of air into the tunnel, connected to each said air inlet opening; and an air outlet opening connected to said duct and located in the tunnel forward of the propeller.

21. The propulsion system of claim 19 wherein at least certain of the valves are variably adjustable from a remote location.

22. The propulsion system of claim 20 wherein at least certain of the valves are variably adjustable from a remote location.

23. The propulsion system of claim 19 wherein there is a plurality of ducts, at least certain of which are fitted with a valve to control the flow of air into the tunnel.

24. The propulsion system of claim 20 wherein there is a plurality of ducts, at least certain of which are fitted with a valve to control the flow of air into the tunnel.

25. The propulsion system of claim 23 wherein at least certain of the valves are variably adjustable.

26. The propulsion system of claim 24 wherein at least certain of the valves are variably adjustable.

27. The propulsion system of claim 19 wherein at least certain of the valves are variably adjustable.

28. The propulsion system of claim 20 wherein at least certain of the valves are variably adjustable.

29. The propulsion system of claim 27 wherein at least certain of the valve are variably adjustable from a remote location.

30. The propulsion system of claim 28 wherein at least certain of the valves are variably adjustable from a remote location.

31. The propulsion system of claim 17 wherein the means for drawing air from the exterior of the powerboat is an air inlet opening external to each tunnel and associated therewith and a duct connecting the air inlet opening with the tunnel.

32. The propulsion system of claim 18 wherein the means for drawing air from the exterior of the powerboat is an air inlet opening external to each tunnel and associated therewith and a duct connecting the air inlet opening with the tunnel.

33. The propulsion system of claim 31 wherein the duct is fitted with a valve to control the flow of air into the tunnel.

34. The propulsion system of claim 32 wherein the duct is fitted with a valve to control the flow of air into the tunnel.

35. The propulsion system of claim 33 wherein the valve is variably adjustable.

36. The propulsion system of claim 34 wherein the valve is variably adjustable.

37. The propulsion system of claim 35 wherein the valve is variably adjustable from a remote location.

38. The propulsion system of claim 36 wherein the valve is variably adjustable from a remote location.

39. The propulsion system of claim 1 wherein the means for drawing air from the exterior of the powerboat is an air inlet opening external to the tunnel and associated therewith and a duct connecting the air inlet opening with the tunnel.

40. The propulsion system of claim 2 wherein the means for drawing air from the exterior of the powerboat is an air inlet opening external to the tunnel and associated therewith and a duct connecting the air inlet opening with the tunnel.

41. The propulsion system of claim 1 wherein the means for drawing air into the tunnel and for conveying the air to and admitting it to the tunnel comprises: at least one air inlet opening located on the exterior hull of the powerboat; a duct connected to each said air inlet opening and; an air outlet opening connected to said duct and located in the tunnel forward of the propeller.

42. The propulsion system of claim 2 wherein the means for drawing air into the tunnel and for conveying the air to and admitting it to the tunnel comprises: at least one air inlet opening located on the exterior hull of the powerboat; a duct connected to each said air inlet opening and; an air outlet opening connected to said duct and located in the tunnel forward of the propeller.

43. The propulsion system of claim 41 wherein there are a plurality of tunnels.

44. The propulsion system of claim 42 wherein there are a plurality of tunnels.

45. The propulsion system of claim 41 wherein there are a plurality of air inlet openings.

46. The propulsion system of claim 42 wherein there are a plurality of air inlet openings.

47. The propulsion system of claim 41 wherein there are a plurality of air outlet openings.

48. The propulsion system of claim 42 wherein there are a plurality of air outlet openings.

49. The propulsion system of claim 41 wherein there are a plurality of ducts.

50. The propulsion system of claim 42 wherein there are a plurality of ducts.

51. The propulsion system of claim 41 wherein there is a plurality of air inlet openings on the powerboat in a location other than on the transom.

52. The propulsion system of claim 42 wherein there is a plurality of air inlet openings on the powerboat in a location other than on the transom.

53. The propulsion system of claim 41 wherein there is a plurality of air inlet openings on the powerboat located on the transom.

54. The propulsion system of claim 42 wherein there is a plurality of air inlet openings on the powerboat located on the transom.

55. The propulsion system of claim 41 in which the air inlet opening is adjacent to and surrounds the rear opening of the tunnel.

56. The propulsion system of claim 42 wherein the air inlet opening is adjacent to and surrounds the rear opening of the tunnel.

57. The propulsion system of claim 41 wherein there is at least one air inlet opening located on the transom of the powerboat exterior to the rear opening of the tunnel and at least one other air inlet opening located on the hull of the powerboat in a location other than the transom.

58. The propulsion system of claim 42 wherein there is at least one air inlet opening located on the transom of the powerboat exterior to the rear opening of the tunnel and at last one other air inlet opening located on the hull of the powerboat in a location other than the transom.

59. The propulsion system of claim 41 wherein the air inlet opening is located on each side of and adjacent to, but not part of, the rear opening of the tunnel.

60. The propulsion system of claim 42 wherein the air inlet opening is located on each side of and adjacent to, but not part of, the rear opening of the tunnel.

61. The propulsion system of claim 43 wherein there are a plurality of air inlet openings.

62. The propulsion system of claim 44 in which there are a plurality of air inlet openings.

63. The propulsion system of claim 43 wherein there are a plurality of air outlet openings located in each tunnel.

64. The propulsion system of claim 43 wherein there are a plurality of air outlet openings located in each tunnel.

65. The propulsion system of claim 43 wherein there are a plurality of ducts.

66. The propulsion system of claim 44 wherein there are a plurality of ducts.

67. The propulsion system of claim 43 wherein the air inlet opening is located on each side of and adjacent to, but not part of, the rear opening of each tunnel.

68. The propulsion system of claim 44 wherein the air inlet opening is located on each side of and adjacent to, but not part of, the rear opening of each tunnel.

69. The propulsion system of claim 43 wherein the air inlet opening is adjacent to and surrounds the rear opening of each tunnel.

70. The propulsion system of claim 44 wherein the air inlet opening is adjacent to and surrounds the rear opening of each tunnel.

71. The propulsion system of claim 43 wherein there is a plurality of air inlet openings on the powerboat in a location other than on the transom.

72. The propulsion system of claim 44 wherein there is a plurality of air inlet openings on the powerboat in a location other than on the transom.

73. The propulsion system of claim 43 wherein there is at least one air inlet opening located on the transom of the powerboat exterior to the rear openings of the tunnels and at least one other air inlet opening located on the hull of the powerboat in a location other than the transom.

74. The propulsion system of claim 44 wherein there is at least one air inlet opening located on the transom of the powerboat exterior to the rear openings of the tunnels and at least one other air inlet opening located on the hull of the powerboat in a location other than the transom.

75. The propulsion system of claim 73 wherein there is a plurality of air inlet openings on the hull of the powerboat in a location other than the transom.

76. The propulsion system of claim 74 wherein there is a plurality of air inlet openings on the hull of the powerboat in a location other than the transom.

77. The propulsion system of claim 43 wherein there is a plurality of air inlet openings on the powerboat located on the transom.

78. The propulsion system of claim 44 wherein there is a plurality of air inlet openings on the powerboat located on the transom.

79. The propulsion system of claim 57 wherein there is a plurality of air inlet openings on the hull of the powerboat in a location other than the transom.

80. The propulsion system of claim 58 wherein there is a plurality of air inlet openings on the hull of the powerboat in a location other than the transom.

* * * * *